US007731529B1

(12) United States Patent
Islam

(10) Patent No.: US 7,731,529 B1
(45) **Date of Patent: *Jun. 8, 2010**

(54) CONNECTOR INCLUDING COMPRESSIBLE RING FOR CLAMPING A CONDUCTOR OF A COAXIAL CABLE AND ASSOCIATED METHODS

(75) Inventor: Nahid Islam, Westmont, IL (US)

(73) Assignee: Andrew LLC, Hickory, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/277,125

(22) Filed: Nov. 24, 2008

(51) Int. Cl.
*H01R 9/05* (2006.01)

(52) U.S. Cl. ..... 439/583

(58) Field of Classification Search ..... 439/583, 439/578, 584–587, 271–275
See application file for complete search history.

(56) References Cited

U.S. PATENT DOCUMENTS

| | | | | |
|---|---|---|---|---|
| 3,040,288 | A | 6/1962 | Edlen et al. | 339/103 |
| 3,103,548 | A | 9/1963 | Concelman | 174/89 |
| 3,106,599 | A | 10/1963 | Leitner et al. | 174/12 |
| 3,671,926 | A | 6/1972 | Nepovim | 339/177 E |
| 3,744,011 | A | 7/1973 | Blanchenot | 339/177 R |
| 3,757,279 | A | 9/1973 | Winston | 339/177 R |
| 3,761,870 | A | 9/1973 | Drezin et al. | 339/177 R |
| 3,847,463 | A | 11/1974 | Hayward et al. | 339/8 P |
| 3,915,539 | A | 10/1975 | Collins | 339/94 C |
| 4,046,451 | A | 9/1977 | Juds et al. | 339/177 R |
| 4,491,685 | A | 1/1985 | Drew et al. | 174/75 C |
| 4,557,546 | A | 12/1985 | Dreyer | 339/177 R |
| 4,585,289 | A | 4/1986 | Bocher | 339/89 C |
| 4,676,577 | A | 6/1987 | Szegda | 439/584 |
| 4,915,651 | A | 4/1990 | Bout | 439/578 |
| 4,923,412 | A | 5/1990 | Morris | 439/578 |
| 5,137,470 | A | 8/1992 | Doles | 439/578 |
| 5,154,636 | A | 10/1992 | Vaccaro et al. | 439/583 |
| 5,267,877 | A | 12/1993 | Scannelli et al. | 439/584 |
| 5,281,167 | A | 1/1994 | Le et al. | 439/578 |
| 5,352,127 | A | 10/1994 | Muller et al. | 439/188 |
| 5,352,134 | A | 10/1994 | Jacobsen et al. | 439/584 |
| 5,509,821 | A | 4/1996 | Small et al. | 439/272 |
| 5,545,059 | A | 8/1996 | Nelson | 439/583 |
| 5,576,675 | A | 11/1996 | Oldfield | 333/260 |
| 5,722,856 | A | 3/1998 | Fuchs et al. | 439/578 |
| 5,785,554 | A | 7/1998 | Ohshiro | 439/584 |
| 5,795,188 | A | 8/1998 | Harwath | 439/583 |
| 5,830,009 | A | 11/1998 | Tettinger | 439/578 |

(Continued)

OTHER PUBLICATIONS

Paynter, "Coupling Nut With Cable Jacket Retention," Jun. 29, 2008, pp. 1-20.

(Continued)

*Primary Examiner*—Chandrika Prasad
(74) *Attorney, Agent, or Firm*—Allen, Dyer, Doppelt, Milbrath & Gilchrist, P.A.

(57) ABSTRACT

A connector is for attachment to a coaxial cable having an inner conductor, an outer conductor, and a dielectric therebetween. The connector includes a connector housing defining a radially outer ramp to receive the outer conductor thereagainst and a back nut. A compressible ring compressibly clamps against the outer conductor opposite the radially outer ramp as the connector housing and back nut are engaged. The connector also includes a center contact to be coupled to the inner conductor and an insulator member in the connector housing for carrying the center contact and having a radially outer support portion to radially support the outer conductor opposite the compressible ring.

23 Claims, 24 Drawing Sheets

U.S. PATENT DOCUMENTS

| | | | | |
|---|---|---|---|---|
| 5,938,474 | A | 8/1999 | Nelson | 439/583 |
| 6,019,636 | A | 2/2000 | Langham | 439/584 |
| 6,109,964 | A | 8/2000 | Kooiman | 439/583 |
| 6,133,532 | A | 10/2000 | Lundback et al. | 174/88 C |
| 6,148,513 | A | 11/2000 | Schiefer et al. | 29/858 |
| 6,203,368 | B1 | 3/2001 | Weidner | 439/579 |
| 6,267,621 | B1 | 7/2001 | Pitschi et al. | 439/584 |
| 6,309,250 | B1 | 10/2001 | Hyzin | 439/578 |
| 6,332,808 | B1 | 12/2001 | Kanda et al. | 439/584 |
| 6,386,915 | B1 | 5/2002 | Nelson | 439/584 |
| 6,396,367 | B1 | 5/2002 | Rosenberger | 333/260 |
| 6,439,924 | B1 | 8/2002 | Kooiman | 439/578 |
| 6,462,637 | B1 | 10/2002 | Laverick | 336/107 |
| 6,607,398 | B2 | 8/2003 | Henningsen | 439/578 |
| 6,668,459 | B2 | 12/2003 | Henningsen | 30/90.2 |
| 6,692,300 | B2 | 2/2004 | Kanda et al. | 439/583 |
| 6,793,529 | B1 | 9/2004 | Buenz | 439/583 |
| 6,802,739 | B2 | 10/2004 | Henningsen | 439/584 |
| 6,808,415 | B1 | 10/2004 | Montena | 439/584 |
| 6,824,415 | B2 | 11/2004 | Wlos | 439/348 |
| 6,835,095 | B2 | 12/2004 | Chen | 439/578 |
| 6,848,931 | B2 | 2/2005 | McMullen et al. | 439/350 |
| 6,848,939 | B2 | 2/2005 | Stirling | 439/578 |
| 6,848,941 | B2 | 2/2005 | Wlos et al. | 439/585 |
| 6,863,565 | B1 | 3/2005 | Kogan et al. | 439/580 |
| 6,893,290 | B2 | 5/2005 | Buenz et al. | 439/578 |
| 6,926,555 | B2 | 8/2005 | Nelson | 439/578 |
| 6,939,169 | B2 | 9/2005 | Islam et al. | 439/578 |
| 7,001,546 | B2 | 2/2006 | Dunk | 439/580 |
| 7,008,264 | B2 | 3/2006 | Wild | 439/578 |
| 7,059,162 | B1 | 6/2006 | Tarpill et al. | 72/112 |
| 7,077,700 | B2 | 7/2006 | Henningsen | 439/583 |
| 7,104,839 | B2 | 9/2006 | Henningsen | 439/578 |
| 7,121,883 | B1 | 10/2006 | Petersen et al. | 439/582 |
| 7,134,189 | B2 | 11/2006 | Buenz et al. | 29/748 |
| 7,144,272 | B1 | 12/2006 | Burris et al. | 439/578 |
| 7,156,696 | B1 | 1/2007 | Montena | 439/584 |
| 7,163,420 | B2 | 1/2007 | Montena | 439/578 |
| 7,179,121 | B1 | 2/2007 | Burris et al. | 439/578 |
| 7,329,149 | B2 | 2/2008 | Montena | 439/584 |
| 7,335,059 | B2 | 2/2008 | Vaccaro | 439/578 |
| 7,381,089 | B2 | 6/2008 | Hosler, Sr. | 439/578 |
| 7,422,477 | B2 | 9/2008 | Eriksen | 439/578 |
| 7,435,135 | B2 | 10/2008 | Wlos | 439/584 |
| 7,448,906 | B1 | 11/2008 | Islam | 439/578 |
| 2005/0118865 | A1 | 6/2005 | Henningsen | 439/578 |
| 2006/0112549 | A1 | 6/2006 | Henningsen | 29/857 |
| 2007/0149047 | A1 | 6/2007 | Wild et al. | 439/578 |
| 2009/0053931 | A1 | 2/2009 | Islam | 439/578 |
| 2009/0186521 | A1* | 7/2009 | McMullen et al. | 439/578 |

OTHER PUBLICATIONS

Paynter, "Coaxial Connector Inner Contact Arrangement," Jul. 15, 2008, pp. 1-17.
Paynter, "Insertion Coupling Coaxial Connector," Nov. 3, 2008, pp. 1-24.
Paynter, "Low PIM Rotatable Connector," Jan. 29, 2009, pp. 1-17.
Islam, "Axial Compression Connector," Nov. 3, 2008, pp. 1-25.
Islam, "Flaring Coaxial Cable End Preparation Tool and Associated Methods", Nov. 24, 2008, pp. 1-32.
Islam, "Connector With Positive Stop and Compressible Ring for coaxial Cable and Associated Methods", Nov. 24, 2008, pp. 1-25.
Islam, "Connector With Retaining Ring for Coaxial Cable and Associated Methods", Nov. 24, 2008, pp. 1-28.
Islam, "Connector With Positive Stop for Coaxial Cable and Associated Methods", Nov. 24, 2008, pp. 1-22.
Islam, "Connector Including Flexible Fingers and Associated Methods," Jan. 28, 2009, pp. 1-26.
Islam, "Inner Conductor Sealing Insulator for Coaxial Connector," Oct. 7, 2008, pp. 1-17.
Islam, "Inner Contact Supporting and Biasing Insulator," Jan. 29, 2009, pp. 1-16.

* cited by examiner

CONNECTOR INCLUDING COMPRESSIBLE RING FOR CLAMPING A CONDUCTOR OF A COAXIAL CABLE AND ASSOCIATED METHODS

FIELD OF THE INVENTION

The present invention relates to the field of connectors for cables, and, more particularly, to connectors for coaxial cables and related methods.

BACKGROUND OF THE INVENTION

Coaxial cables are widely used to carry high frequency electrical signals. Coaxial cables enjoy a relatively high bandwidth, low signal losses, are mechanically robust, and are relatively low cost. One particularly advantageous use of a coaxial cable is for connecting electronics at a cellular or wireless base station to an antenna mounted at the top of a nearby antenna tower. For example, the transmitter located in an equipment shelter may be connected to a transmit antenna supported by the antenna tower. Similarly, the receiver is also connected to its associated receiver antenna by a coaxial cable path.

A typical installation includes a relatively large diameter coaxial cable extending between the equipment shelter and the top of the antenna tower to thereby reduce signal losses. Some coaxial cables include a smooth outer conductor while other coaxial cables instead have a corrugated outer conductor. These coaxial cables also have an inner conductor and a dielectric between the outer conductor and the inner conductor. Some inner conductors are hollow, while other inner conductors are formed around an inner conductor dielectric core.

A typical connector for such a coaxial cable includes a connector housing to make an electrical connection to the outer conductor and a center contact to make electrical connection to the inner conductor of the coaxial cable. Such a connector may also include a back nut that is positioned onto the end of the outer conductor and adjacent the outer insulating jacket portion of the coaxial cable.

U.S. Pat. No. 5,795,188 to Harwath, for example, discloses a connector for a coaxial cable having a corrugated outer conductor. The connector includes a connector housing defining a radially outer ramp to contact the inside surface of a flared end portion of an outer conductor of the coaxial cable. A clamping ring is in the corrugation adjacent to the flared end portion of the outer conductor. The clamping ring presses the outer surface of the outer conductor against the radially outer ramp to provide electrical contact therebetween.

U.S. Pat. No. 7,011,546 to Vaccaro discloses a connector for a coaxial cable having a smooth outer conductor. The connector includes a connector housing, a back nut threadingly engaging a rearward end of the connector housing, a ferrule gripping and advancing an end of the coaxial cable into the connector housing as the back nut is tightened, and an insulator member positioned within a medial portion of the connector housing. The insulator member has a bore extending therethrough and includes a forward disk portion, a rearward disk portion, a ring portion connecting the forward and disk portions together, and a tubular outer conductor support portion extending rearwardly from the rearward disk portion for supporting an interior surface of the outer conductor of the coaxial cable.

U.S. Pat. No. 7,077,700 to Henningsen discloses a coaxial connector including a removable back nut, an outer body, and a center conductor supported within the outer body by a dielectric. An uncompressible clamp ring is rotatably disposed within the central bore of the back nut. A prepared end of a coaxial cable is inserted through the back nut, and the end portion of the outer conductor of the coaxial cable is flared outwardly. As the back nut is tightened onto the outer body, the flared end of the outer conductor is clamped between mating clamping surfaces formed on the clamp ring and the outer body.

Despite these exemplary advances in connector technology, a desire remains for connectors that install easily and maintain good electrical contact with the coaxial cable despite changes in outer conductor shape, such as may be caused by thermal expansion and/or aluminum creep.

SUMMARY OF THE INVENTION

In view of the foregoing background, it is therefore an object of the present invention to provide an easy to install connector for a coaxial cable that maintains good electrical contact therewith over a variety of operating conditions.

This and other objects, features, and advantages in accordance with the present invention are provided by a connector to be attached to a coaxial cable comprising an inner conductor, an outer conductor having a corrugated end, and a dielectric therebetween. The connector may comprise a connector housing defining a radially outer ramp having a predetermined shape to receive the corrugated end of the outer conductor thereagainst and a back nut.

A compressible ring may compressibly clamp against the outer conductor opposite the radially outer ramp as the connector housing and back nut are engaged. This advantageously provides secure mechanical and electrical connections between the outer conductor and the connector housing. Furthermore, this maintains a sufficient clamping force on the outer conductor opposite the radially outer ramp even if the size and/or shape of the outer conductor changes due to thermal expansion or aluminum creep.

A center contact may be coupled to the inner conductor. An insulator member may be in the connector housing for carrying the center contact and may comprise a radially outer support portion to radially support the outer conductor opposite the compressible ring. This radial support supports the outer conductor radially outwardly as the compressible ring urges the outer conductor radially inwardly.

The compressible ring may be made of metal coil then coated with polymer or non conductive material. The compressible ring may be an electrically conductive compressible ring. The clamping ring may additionally or alternatively be an electrically conductive compressible coil spring having an axis coaxial with the connector housing.

A portion of the connector housing and the back nut may include respective portions defining a positive stop when fully engaged. More particularly, the positive stop may be defined by a rearward end of the connector housing and shoulder of the back nut. This positive stop may allow the connector to be attached to the coaxial cable without a torque wrench or other torque limiting tool, as the positive stop indicates to the installer when to stop tightening the back nut and the connector housing together.

A portion of the back nut may include a forward portion threadingly received with a rearward portion of the connector housing. The insulator member may include a rearward portion engaging the dielectric of the coaxial cable to define a positive stop therewith. This positive stop of the insulator member may indicate to an installer that the connector housing is firmly placed onto the coaxial cable.

At least one sealing ring may be carried within the back nut. The back nut may have a sealing ring cavity defined therein. The sealing ring may comprise a sealing ring body and a retaining projection extending outwardly therefrom and the retaining projection may be received by the sealing ring cavity. This sealing ring may seal the interior of the connector housing and the back nut from moisture and debris. The back nut may comprise a polymer composite back nut.

The outer conductor of the coaxial cable may comprise a smoothwall cable corrugated outer conductor. The outer conductor of the coaxial cable may alternatively comprise a smooth outer conductor. Indeed, in some applications, the connector may accommodate both corrugated and smooth outer conductors. This advantageously allows a same connector to be used for multiple cable types.

Another aspect is directed to a method of making a connector to be attached to a coaxial cable comprising an inner conductor, an outer conductor having a corrugated end, and a dielectric therebetween. The method comprises defining a radially outer ramp on a connector housing to receive the corrugated end of the outer conductor thereagainst and forming a compressible ring to compressibly clamp against the outer conductor opposite the radially outer ramp as the connector housing and a back nut are engaged. An insulator member is positioned in the connector housing for carrying a center contact to be coupled to the inner conductor and comprising a radially outer support portion to radially support the outer conductor opposite the compressible ring.

DETAILED DESCRIPTION OF THE PREFERRED EMBODIMENTS

Figure 1:
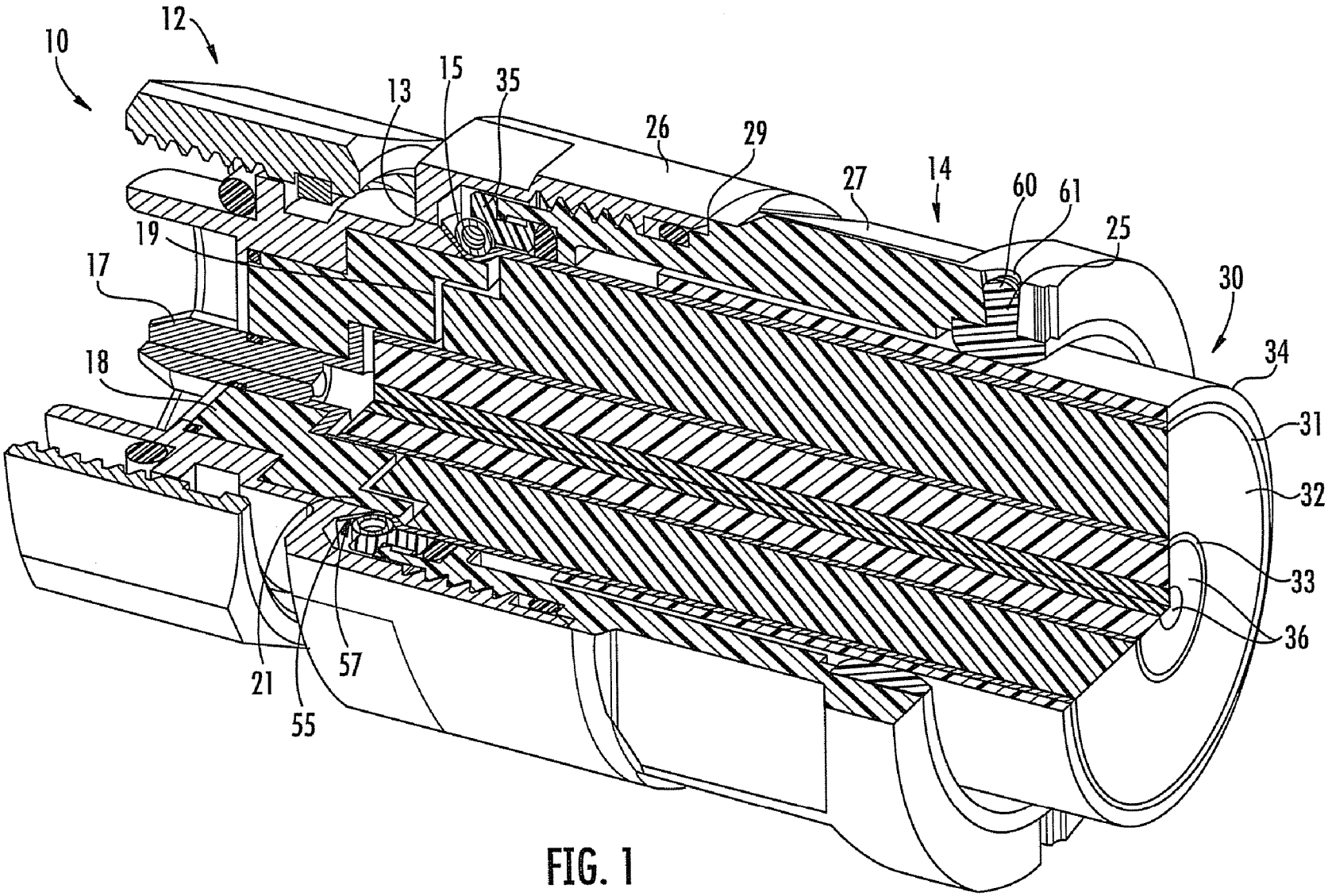
FIG. 1 is a perspective cutaway view of a connector installed on the end of a coaxial cable having a smooth outer conductor in accordance with the present invention.
Figure 2:
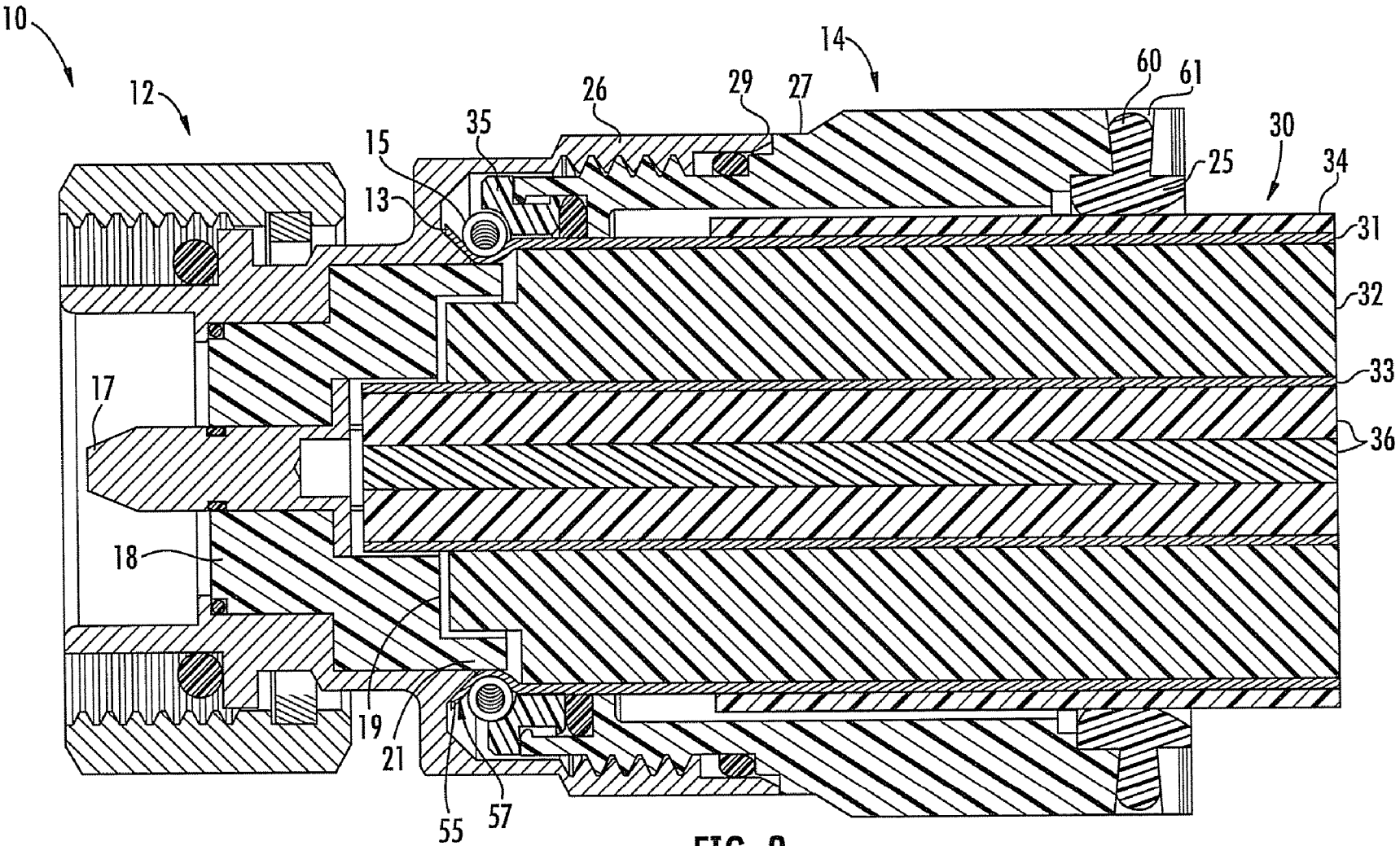
FIG. 2 is a longitudinal cross-sectional view of the connector of FIG. 1.
Figure 3:
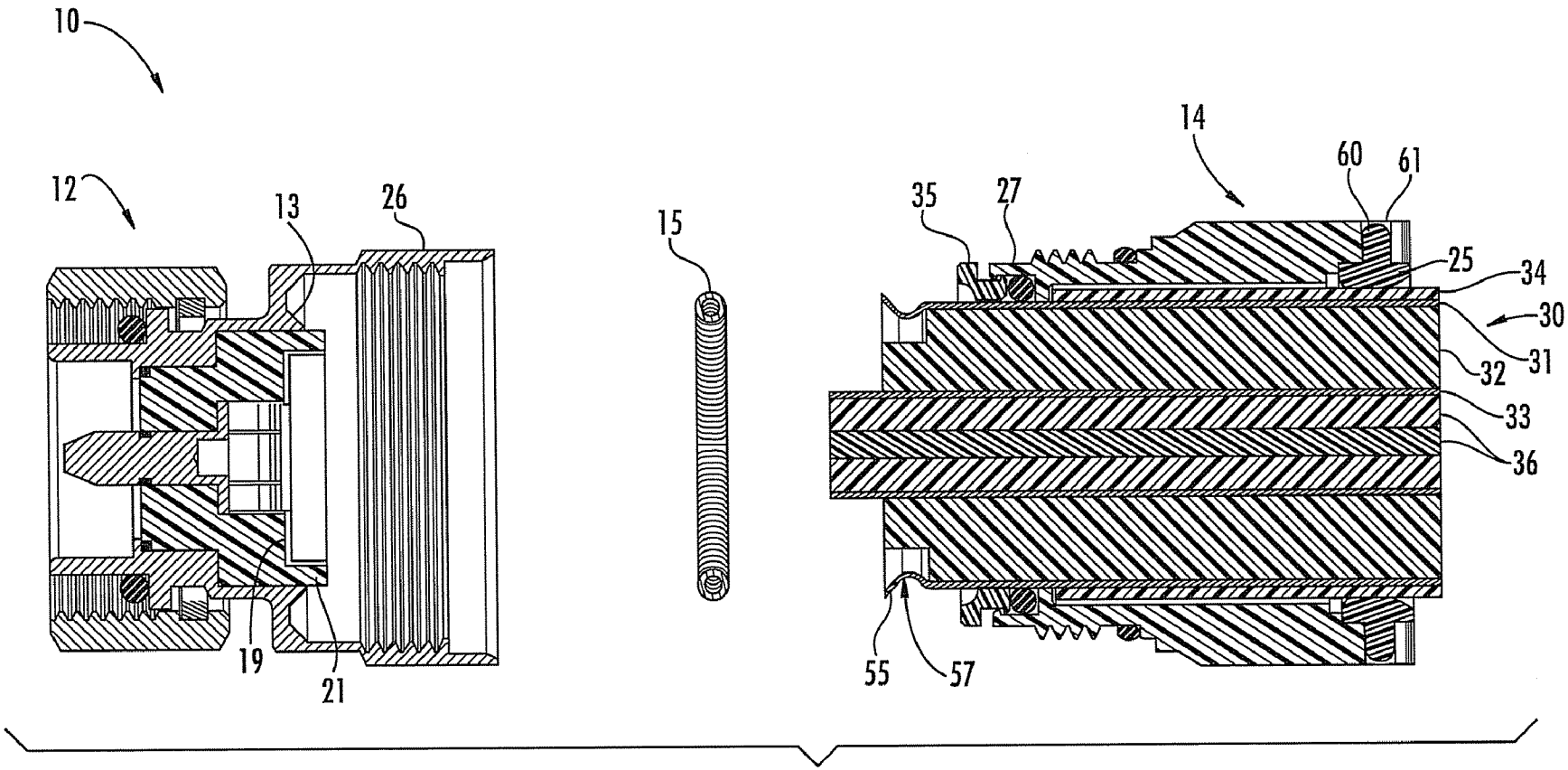
FIG. 3 is an exploded cross-sectional view of the connector of FIG. 1.
Figure 4:
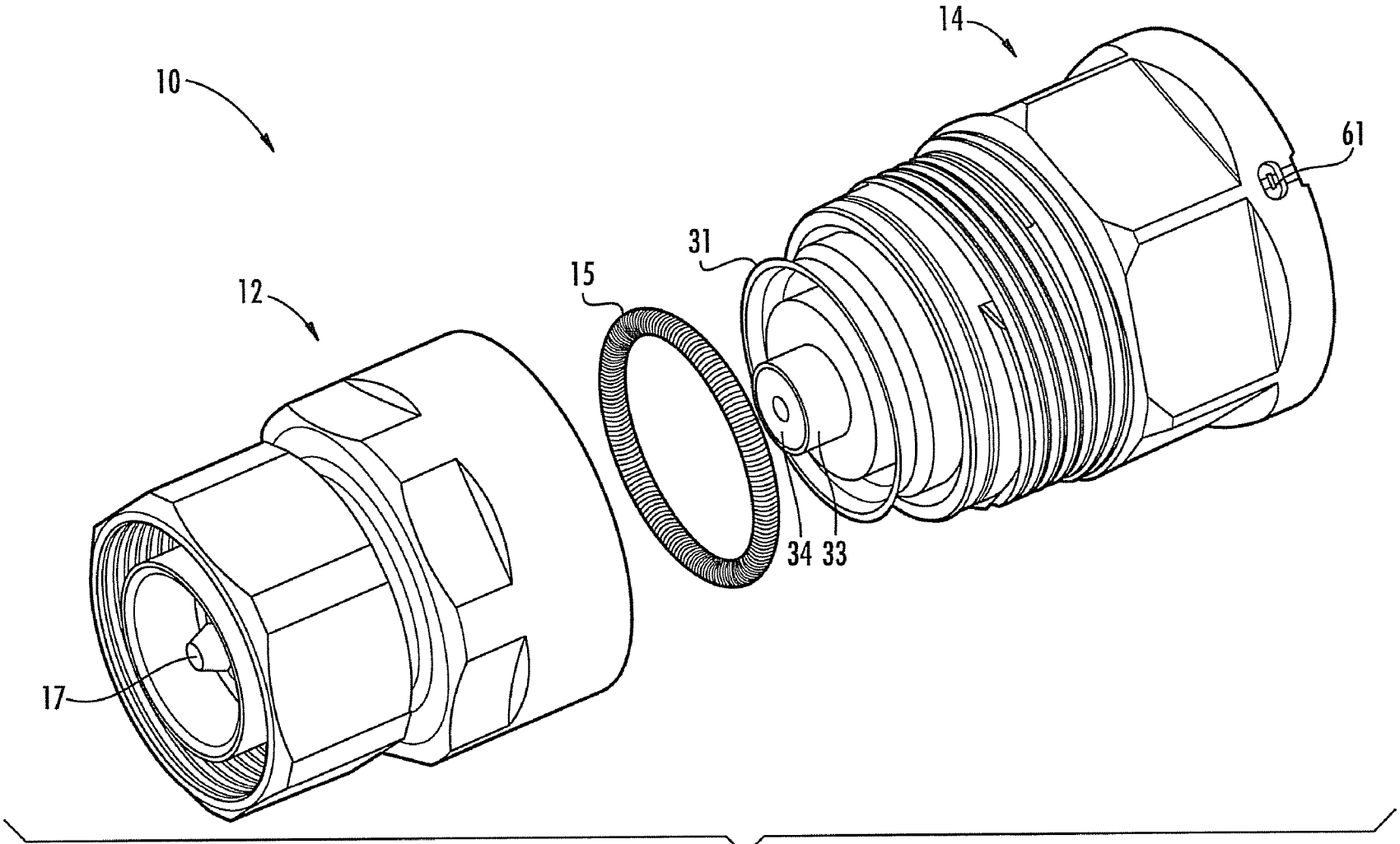
FIG. 4 is an exploded view of the connector of FIG. 1.
Figure 5:
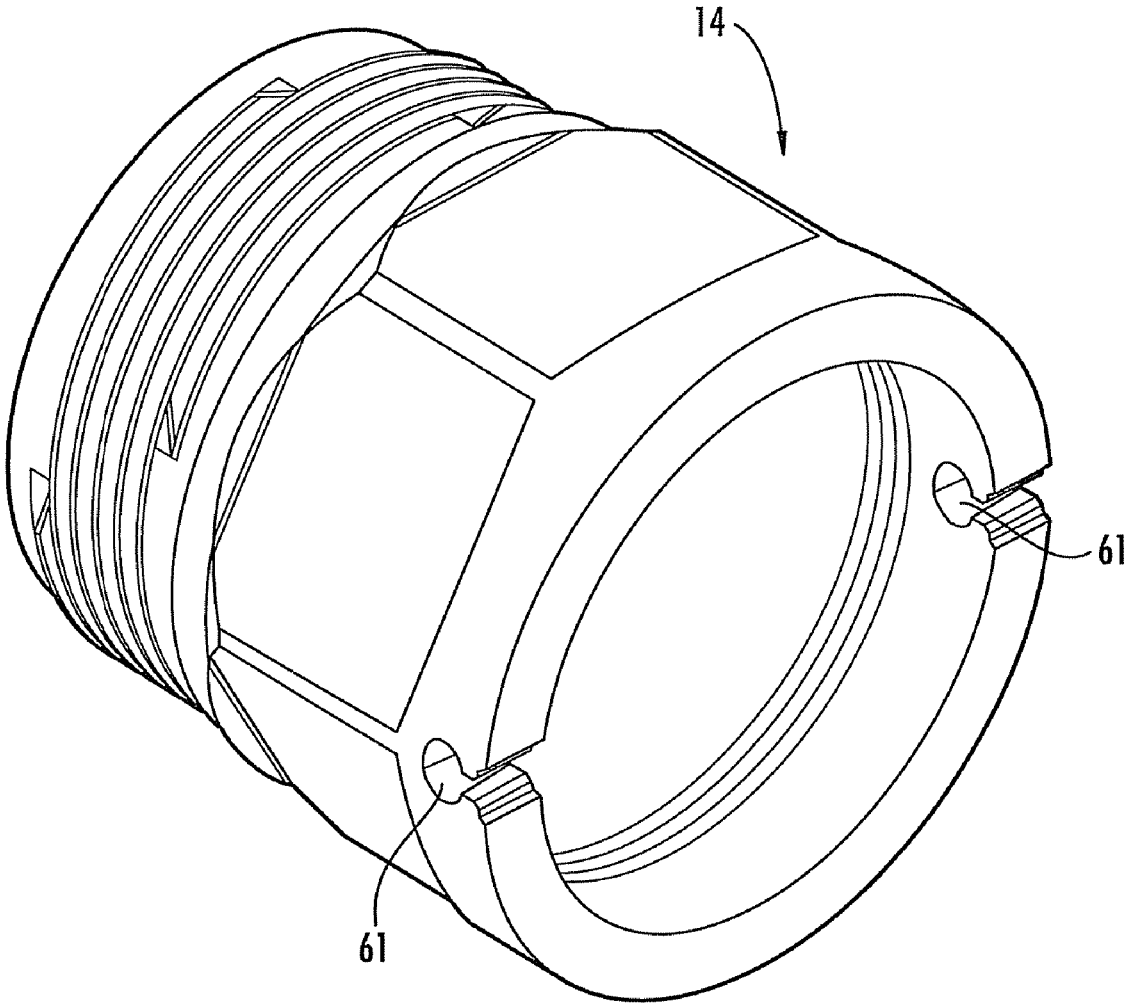
FIG. 5 is a perspective view of the back nut of FIG. 1 not installed on the end of the coaxial cable.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and multiple prime notation are used to indicate similar elements in alternative embodiments.

Referring initially to FIGS. 1-4, a connector 10 to be attached to a coaxial cable 30 is now described. The coaxial cable 30 comprises an inner conductor 33, an outer conductor 31, and a dielectric 32 therebetween. The inner conductor 33 is illustratively a hollow inner with an inner conductor dielectric core 36. The outer conductor 31 is illustratively a smooth outer conductor with a corrugated end 57, but could be a corrugated outer conductor in other embodiments. The dielectrics 32, 36 may be foam dielectrics or other dielectric as known to those skilled in the art.

The end of the coaxial cable 30 is prepared so that the inner conductor 33 extends longitudinally outwardly beyond the end of the outer conductor 31. In addition, portions of the dielectric 32 are removed in a stair-stepped fashion so that the inner surface of the outer conductor 31 is also exposed. The coaxial cable 30 illustratively includes an outer insulation jacket 34 stripped back a distance so that outer end portions of the outer conductor 31 are exposed. The outer conductor 31 is flared outwardly to define a flared portion 55. A corrugated portion 56 of the corrugated end 57 of outer conductor 31 illustratively has a diameter less than that of other portions of the outer conductor.

Of course, the skilled artisan will recognize that, in some applications, the coaxial cable 30 may be prepared differently and may not have the corrugated portion 56. Devices and methods for preparing the end of the coaxial cable 30 will be described in detail below.

The connector 10 comprises a connector housing 12 defining a radially outer ramp 13 having a predetermined shape to receive the corrugated end 57 of the outer conductor 31 thereagainst. The radially outer ramp 13 illustratively has a smooth continuous ramp surface, although it should be understood that other ramp surfaces may be used. For example, the radially outer ramp 13 may be a stair-stepped ramp or may be a radiused ramp.

The connector 10 includes an externally threaded back nut 14 threaded into the internally threaded rearward end of the connector housing 12. The back nut 14 illustratively comprises a polymer composite material, although of course in other applications the back nut could comprise a metal. Construction of the back nut 14 from the polymer composite material ensures that contact between the back nut and the outer conductor does not negatively affect intermodulation distortion (IMD). Furthermore, construction of the back nut 14 from a polymer composite material helps prevent galvanic corrosion between the components of the back nut and the coaxial cable 30.

Figure 8:
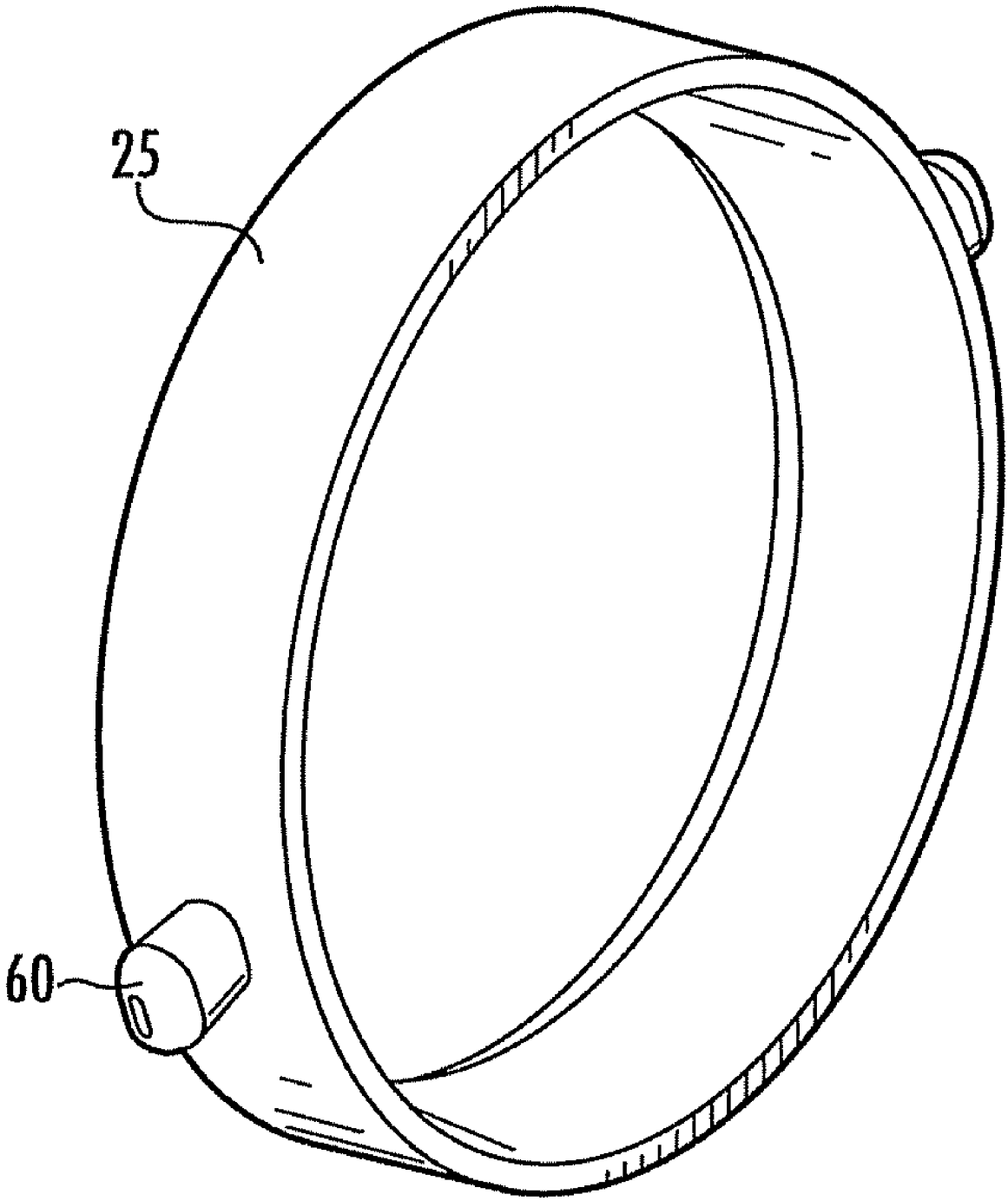
FIG. 8 is a perspective view of the rearward o-ring of the connector of FIG. 1.
Figure 9:
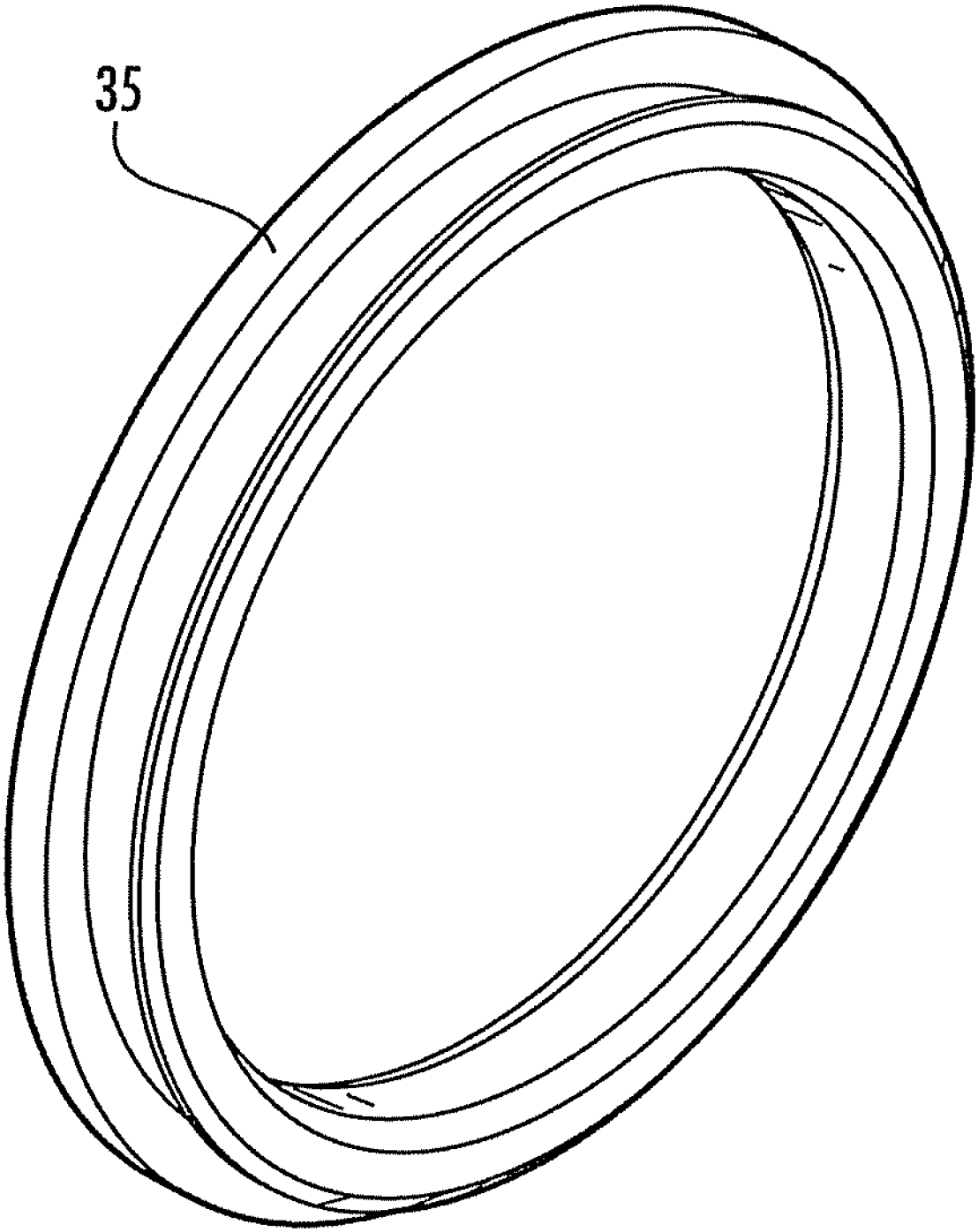
FIG. 9 is a perspective view of the ferrule of the connector of FIG. 1.

A forward o-ring 28 and a rearward o-ring 25 are illustratively provided to seal respective forward and rearward interfaces adjacent the back nut 14 and may prevent moisture ingress, as will be understood by those of skill in the art. As perhaps best shown in FIG. 8, the rearward O-ring 25 has a retaining projection 60 extending outwardly therefrom. This retaining projection is received by recess 61 defined in the back nut 14. The retaining projection 60 and recess 61 securely locate the rearward o-ring 25 in the back nut and help prevent movement of the rearward o-ring during installation of the back nut 14 onto the coaxial cable 30.

A compressible ring 15 compressibly clamps against the outer conductor 31 opposite the radially outer ramp 13 as the connector housing 12 and back nut 14 are engaged. This clamping helps to provide a secure mechanical and electrical connection between the outer conductor 31 and the radially outer ramp 13. By maintaining a secure electrical connection, the intermodulation distortion of signals traveling through the coaxial cable 30 may be reduced.

The compressible ring 15 advantageously maintains a sufficient clamping force on the outer conductor 31 even if the outer conductor changes shape or size due to thermal expansion or creep, for example, whereas an arrangement of two wedging surfaces to clamp the outer conductor might lose clamping force and contact pressure if the outer conductor were to change shape or size. Furthermore, by maintaining a constant clamping force on the outer conductor 31, the compressible ring 15 allows the connector 10 to be used with both smooth wall outer conductor coaxial cables 30 corrugated outer conductor coaxial cables. In addition the compressible ring 15 allows the connector 10 to be used on a variety of coaxial cables with different thicknesses, and on a variety of coaxial cables with outer conductors having different thicknesses.

The compressible ring 15 illustratively comprises an electrically conductive compressible coil spring having an axis coaxial with that of the connector housing 12, although those of skill in the art will appreciate that any suitable compressible ring may be used. In some applications, the compressible ring 15 may not be electrically conductive. Indeed, the compressible ring 15 may be constructed from an electrically conductive material then coated with a non-conductive coating, such as a polymer coating. Alternatively, the compressible ring 15 may be constructed from a non-conductive material.

Figure 6:
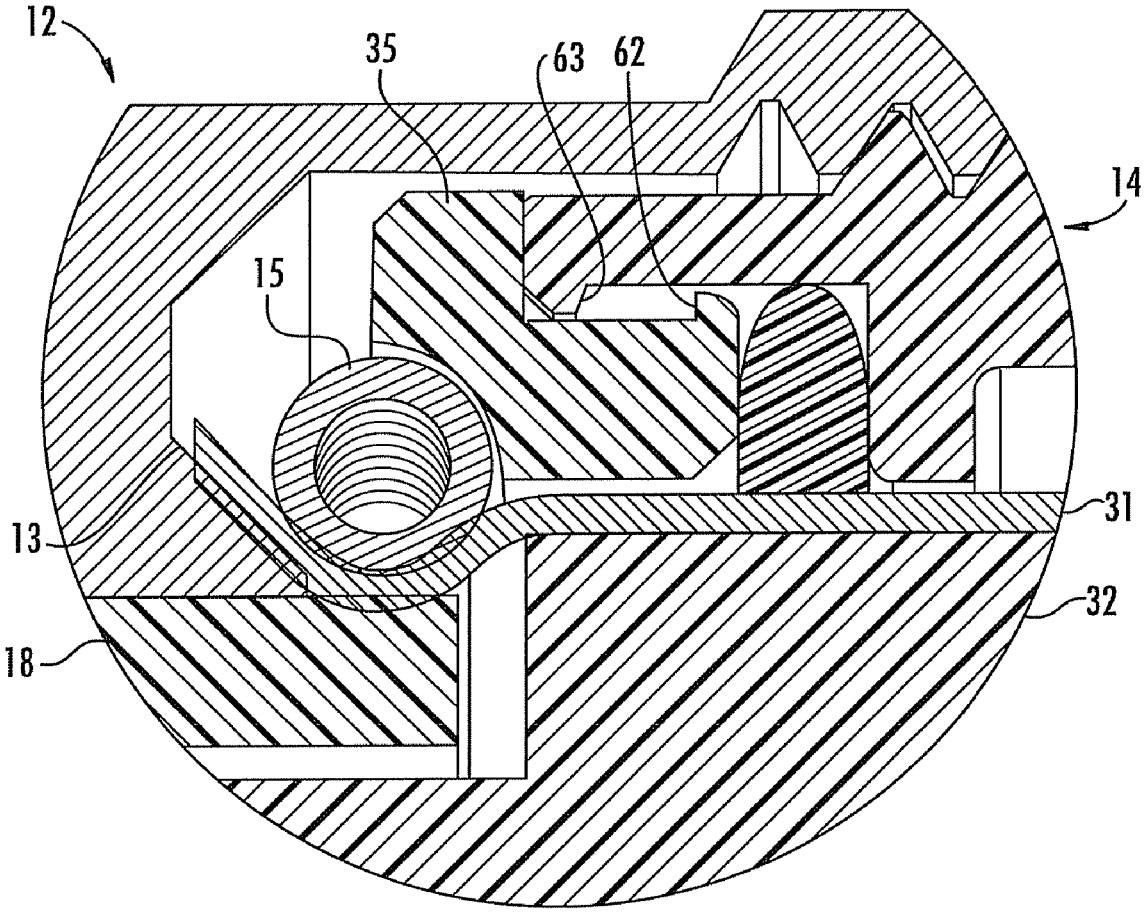
FIG. 6 is a greatly enlarged cross-sectional view of the compressible ring and ferrule of the connector of FIG. 1.

The back nut 14 illustratively includes a ferrule 35 (FIG. 6, 9) to press against the compressible ring 15 as the connector housing 12 and back nut 14 are engaged. The ferrule 35 is illustratively constructed from a polymer composite material, although of course the ferrule may also be constructed from metal and formed by casting or metal injection molding. The ferrule has a retaining projection 62 extending radially outwardly therefrom to engage a retaining projection 63 of the back nut 14. The retaining projections 62, 63 engage when the back nut 14 is advanced axially away from the connector housing 12 so that the ferrule 35 remains in the back nut. Of course, the ferrule 35 is optional and may not be included in all applications.

Figure 7:
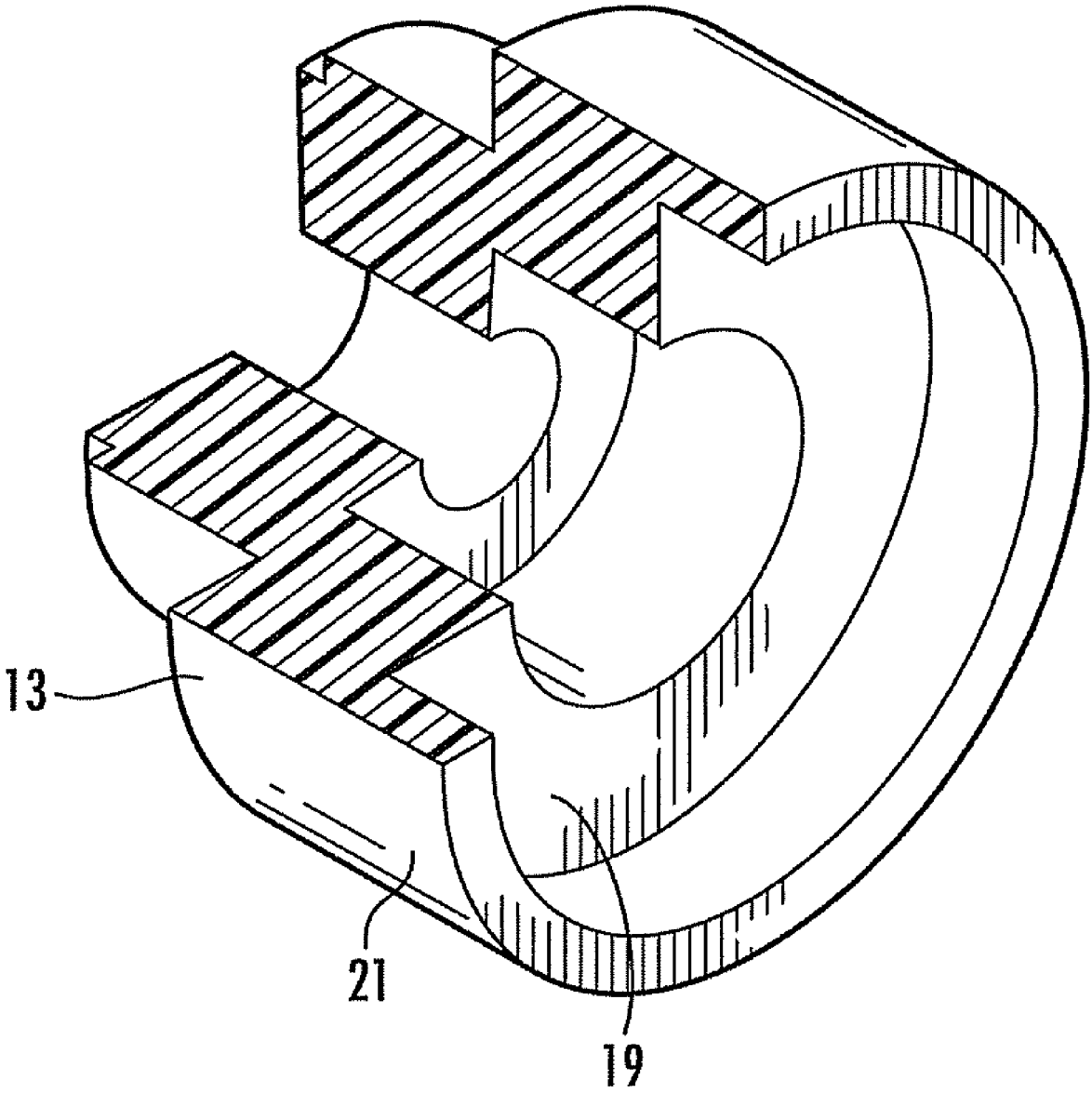
FIG. 7 is a perspective cutaway view of the insulator member of the connector of FIG. 1.

A center contact 17 is supported in the connector housing 12 by an insulator member 18 (FIG. 7) and is electrically connected to the inner conductor 33. The insulator member 18 comprises a radially outer support portion 21 to radially support the outer conductor 31 opposite the compressible ring 15. This radial support supports the outer conductor 31 radially outwardly as the compressible ring 15 urges the outer conductor radially inwardly. Furthermore, the radially outer support portion 21 helps to reduce the chance of a loss of electrical contact between the outer conductor 31 and the radially outer ramp 13 due to flexing of the coaxial cable 30 or due to compression of the dielectric 32.

The insulator member 18 illustratively includes a rearward portion 19 engaging the dielectric 32 of the coaxial cable 30. The illustrated insulator member 18 is a monolithically formed unit. Of course, the insulator member 18 may instead comprise a two-piece unit.

A portion of the connector housing 12 and a portion of the back nut 14 include respective contacting portions defining a positive stop 29 when fully engaged. More particularly, a back end 27 of the connector housing 12 and a shoulder 27 of the back nut 14 define the positive stop 29, although it should be understood that other variations of the positive stop are possible. Indeed, the connector housing 12 may have a shoulder to engage with a front portion of the back nut 14 to define the positive stop 29.

The positive stop 29 helps prevent overtightening of the engagement between the connector housing 12 and the back nut 14 that may generate compression and or shearing forces at potentially damaging levels. The positive stop 29 therefore facilitates easy installation of the connector 10 on the coaxial cable 30 by eliminating the need for a torque wrench or other torque limiting tool.

Figure 10:
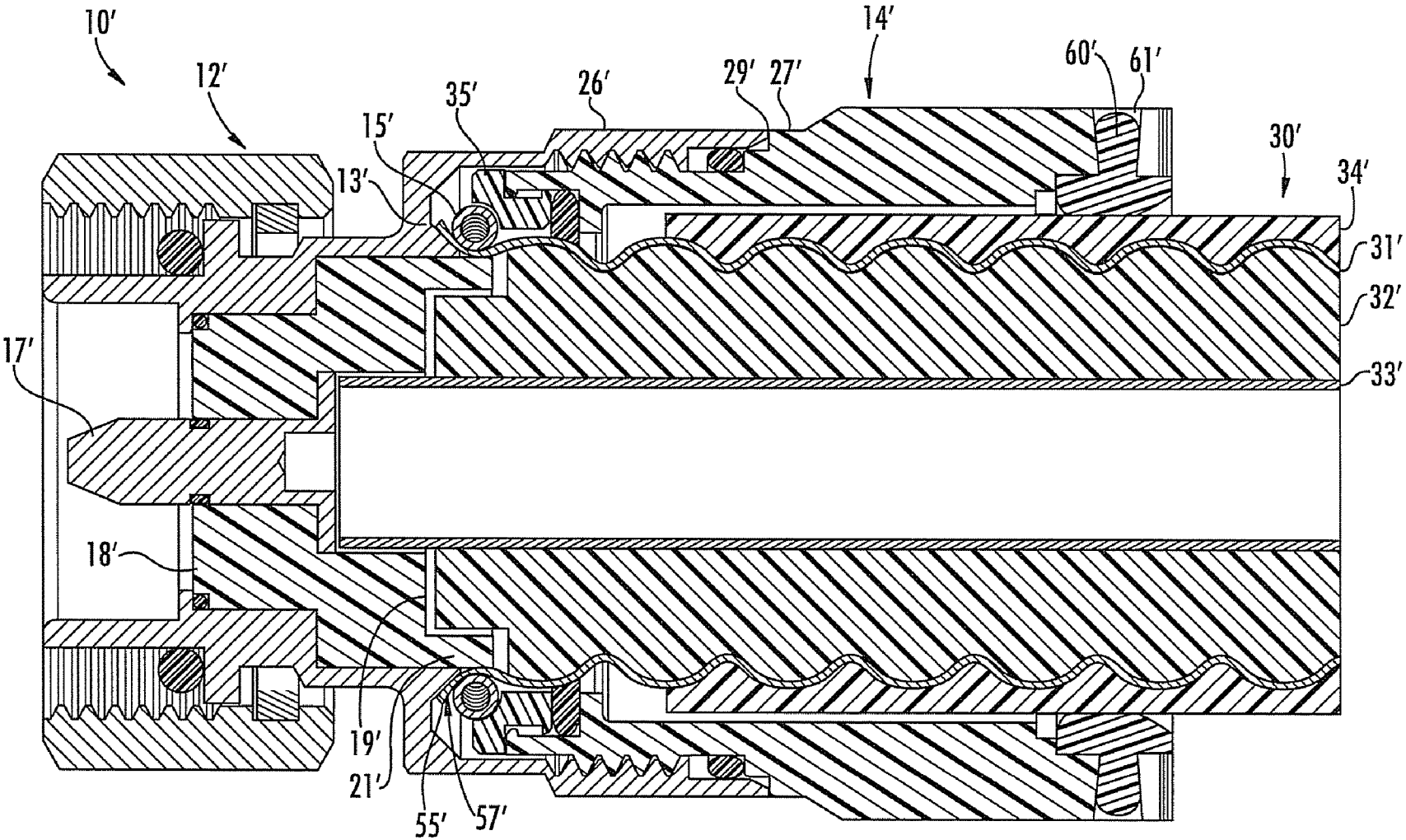
FIG. 10 is a longitudinal cross-sectional view of an alternative embodiment of a connector installed on the end of a coaxial cable having a corrugated outer conductor in accordance with the present invention.

With brief reference to FIG. 10, it should be understood that the connector 10' may also be usable with coaxial cables 30' having corrugated outer conductors 31'. Those other elements not specifically mentioned are indicated with prime notation and are similar to the elements described above with reference to FIG. 1. Accordingly, those other elements require no further description herein.

Figure 11:
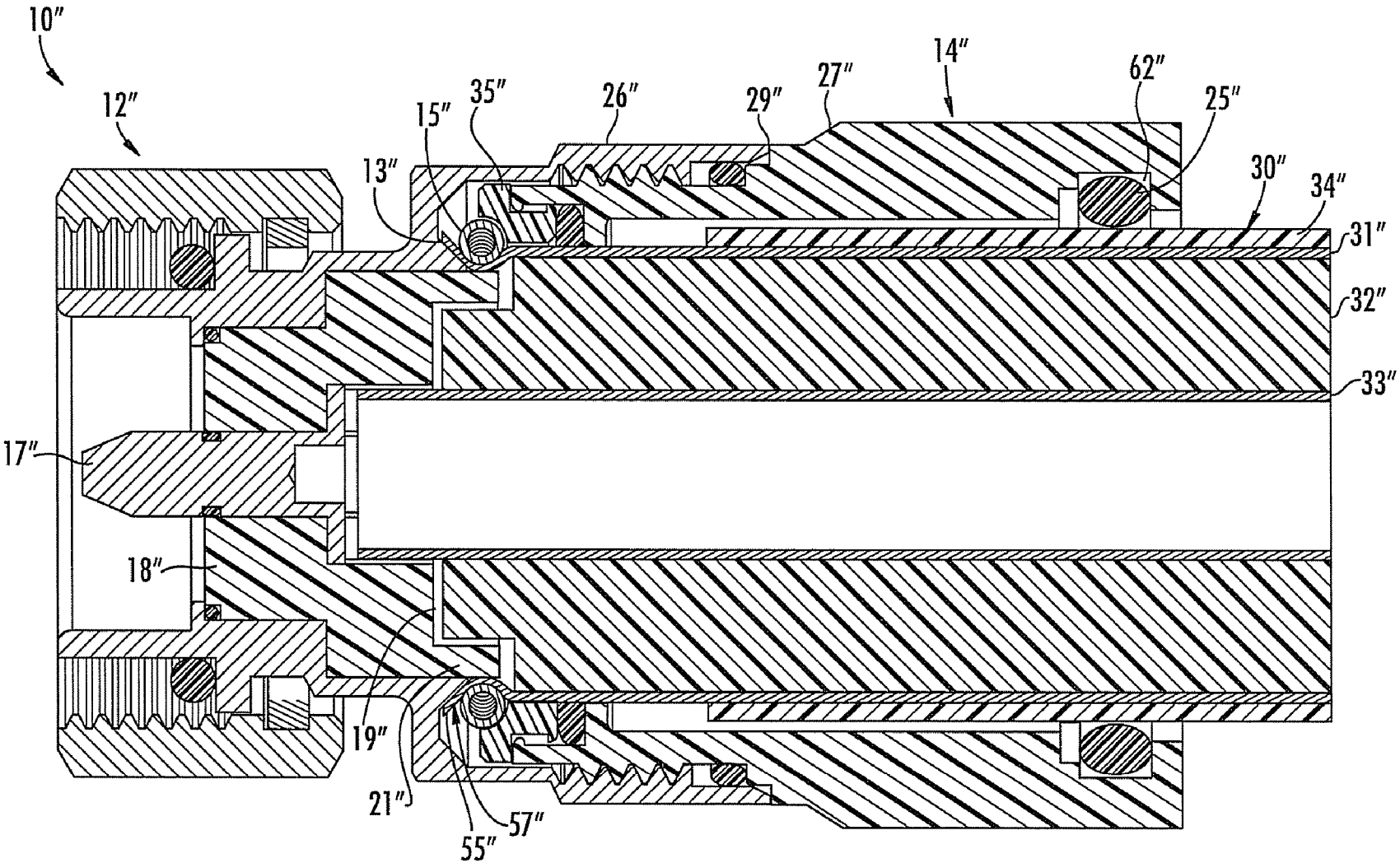
FIG. 11 is a longitudinal cross-sectional view of yet another embodiment of a connector installed on the end of a coaxial cable having a smooth outer conductor in accordance with the present invention.
Figure 12:
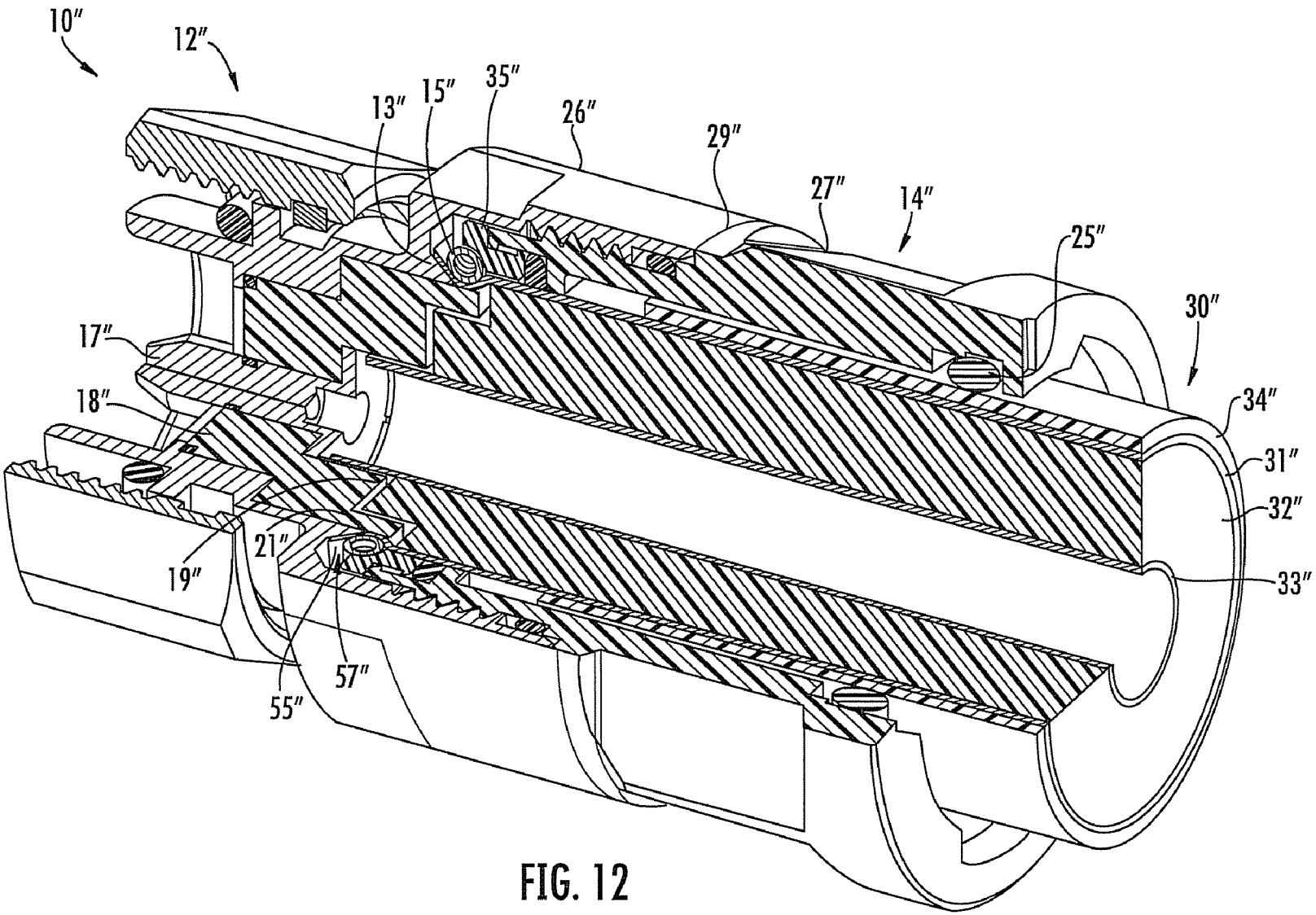
FIG. 12 is a perspective cutaway view of the connector of FIG. 11.

Additionally, with brief reference to FIG. 11-12, those skilled in the art will understand that the rearward o-ring 25" may lack a retaining projection. Instead, in such an embodiment, the rearward o-ring 25" is received by an o-ring pocket 62". Furthermore, the coaxial cable 30" illustratively has a hollow inner conductor 33" without an inner conductor dielectric. Those other elements not specifically mentioned are indicated with double prime notation and are similar to the elements described above with reference to FIG. 1. Accordingly, those other elements require no further description herein.

Figure 13:
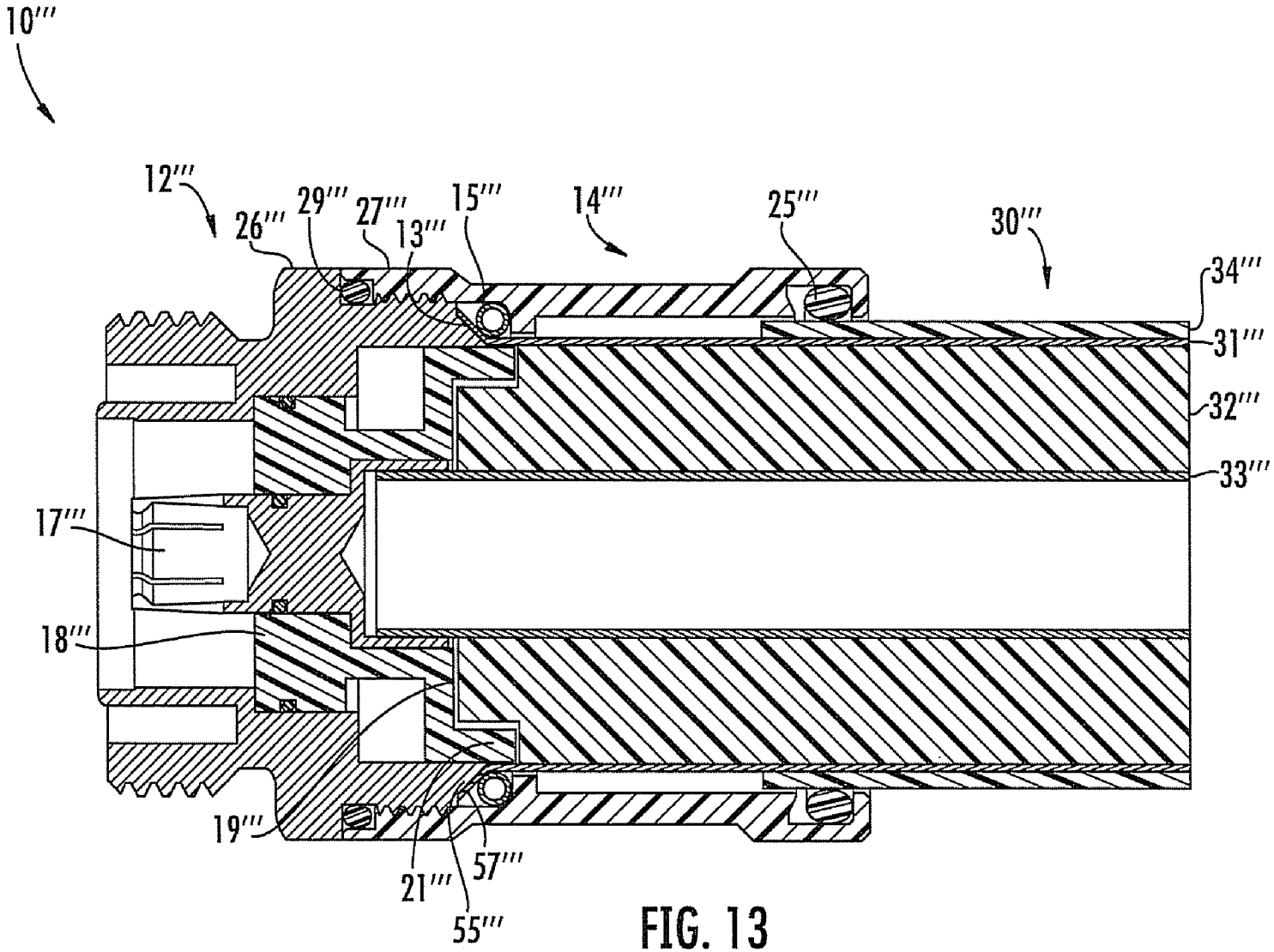
FIG. 13 is a longitudinal cross-sectional view of a further embodiment of a connector installed on the end of a coaxial cable having a smooth outer conductor in accordance with the present invention.

Skilled artisans will appreciate that further configurations of the connector housing 12 and back nut 14 may be used. For example, in an embodiment of the connector 10''' illustrated in FIG. 13, the connector housing 12" is threadingly received by the back nut 14'''. It should also be noted that in this illustrated embodiment, the outer conductor 31''' does not have a corrugated end and that the radially outer ramp 13''' is not shaped to receive such a corrugated end. Accordingly, skilled artisans will understand that such a feature is optional. Furthermore, there is no ferrule. Those other elements not specifically mentioned are indicated with triple prime notation and are similar to the elements described above with reference to FIG. 11. Accordingly, those other elements require no further description herein.

Another aspect is directed to a method of making a connector 10 to be attached to a coaxial cable 30 comprising an inner conductor 33, an outer conductor 31, and a dielectric therebetween 32. The method comprises defining a radially outer ramp 13 on a connector housing 12 to receive the outer conductor thereagainst 31 and forming a compressible ring 15 to compressibly clamp against the outer conductor opposite the radially outer ramp as the connector housing and a back nut 14 are engaged. An insulator member 18 is positioned in the connector housing 12 for carrying a center contact 17 to be coupled to the inner conductor 33 and comprising a radially outer support portion 21 to radially support the outer conductor 31 opposite the compressible ring 15.

With reference to FIGS. 14A-14B, 15A-16B, and 20, a cable end preparation tool 40 for a coaxial cable 30 is now described. It should be noted that, while the tool 40 is described herein by way of example for use with cellular tower cable installations, the tool may of course be used for cable end preparation in other applications as well.

The coaxial cable 30 comprises an inner conductor 33, an outer conductor 31, and a dielectric 32 therebetween. An optional dielectric jacket 51 surrounds the outer conductor 31. It should be appreciated that the end of the illustrated coaxial cable 30 has been prepared by the tool 40.

Although the illustrated coaxial cable 30 has a smooth outer conductor 31, it should be understood that the cable end preparation tool 40 may also be used with a coaxial cable having a corrugated outer conductor. Before using the cable end preparation tool 40, a technician will typically cut the coaxial cable 30. The coaxial cable 30 is cut so that the outer conductor 31 and dielectric 32 are flush with each other while the inner conductor 33 protrudes therebeyond.

The cable end preparation tool 40 illustratively comprises a body 41 having a central opening 42 therein. The central opening 42 may be sized according to the coaxial cable 30 size and may receive the inner conductor 33 to steady and align the tool 40 on the cable end so that the user may push the body 41 toward the cable 51 and rotate or twist it about the central axis thereof.

In the illustrated example, the body 41 is disk shaped, but other body shapes may also be used in different applications. The body 41 may be made from a variety of materials, such as metal and plastic, for example, using common manufacturing techniques known to those skilled in the art. The body may include a plurality of raised gripping surfaces 66 (knurls, for example) thereon to help facilitate gripping by the user, although a variety of textured surfaces or other gripping features (e.g. dimples, grooves, etc) may also be used, if desired, but such gripping features are in no way required.

A blade 43 is carried by the body and is for removing a portion of the dielectric 32 between the inner conductor and the outer conductor when the body 41 is rotated about the coaxial cable 30. The removal of the portion of the dielectric 32 occurs when the user rotates the body 41 by hand and pushes the body toward the cable 30.

It should be noted that the blade 43 need not necessarily strip all of the dielectric 32 from the outer conductor 31 and the inner conductor 33 in all applications. That is, a residual amount of dielectric material may remain on the outer conductor 31 and the inner conductor 33, which may be cleaned off by hand if desired. Skilled artisans will recognize that there may be an adhesive layer between the outer conductor 31 and the dielectric 32 and that a residual amount of this adhesive layer may remain after the blade 43 is used to strip the dielectric from the outer conductor. The body 42 also illustratively includes a blade access opening 48, which not only allows cuttings to pass through the cable end preparation tool 40 but may also allow the blade to be removed and/or replaced, if desired.

Figure 23:
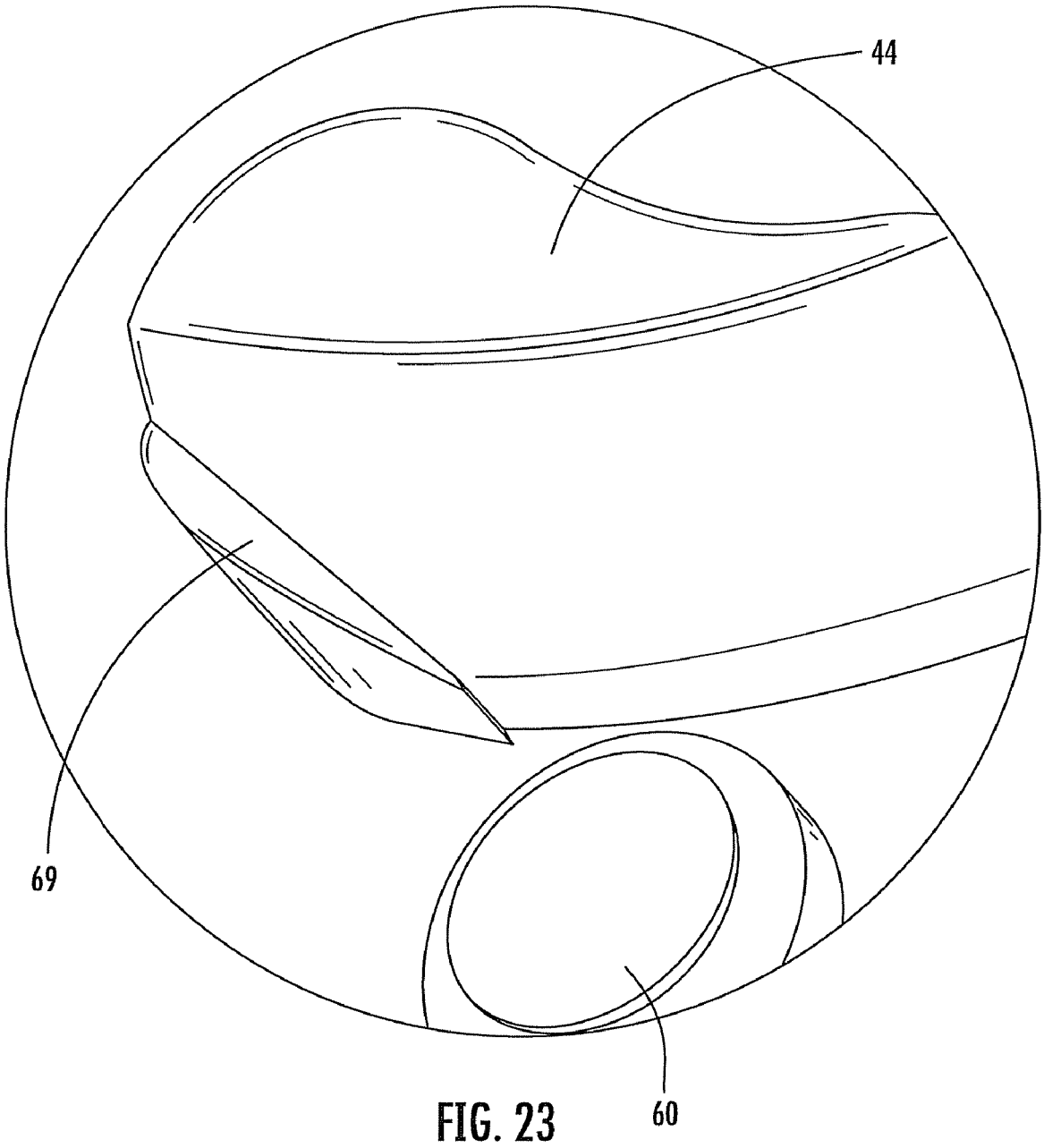
FIG. 23 is a greatly enlarged perspective view of the first projection of the cable preparation tool of FIGS. 14A-14B.

The tool includes a first projection 44 (FIG. 23) carried by the body 41 and having a predetermined shape for flaring an end portion of the outer conductor 55 when the body is rotated relative to the coaxial cable 30. The first projection 44 has an outwardly extending portion 69 having a predetermined shape for beginning flaring of an end portion of the outer conductor 31 when the body 41 is rotated relative to the coaxial cable 30. Furthermore, as the user rotates the body 41 and pushes the body toward the cable 30, the first projection 44 continues causing the outer conductor 31 to flare outwardly. The result of this flaring is perhaps best shown by the flared end 55 of the coaxial cable 30 in FIG. 20. Of course, the first projection 44 need not have the outwardly extending portion 69 in all applications.

It should be understood that the predetermined shape of the first projection 44 may also remove at least a portion of a residual adhesive layer from the outer conductor 31 as the body 41 is rotated relative to the coaxial cable 30. The removal of this adhesive layer may enhance an electrical contact made between the outer conductor 31 and a connector.

A stabilizing projection 60 extends outwardly from the body 41. The stabilizing projection 60 receives the jacket 34 of the coaxial cable 30 thereagainst during use of the tool 40. This stabilizing projection 60 helps to stabilize the tool 40 as it is rotated about the coaxial cable 30.

Figure 14A:
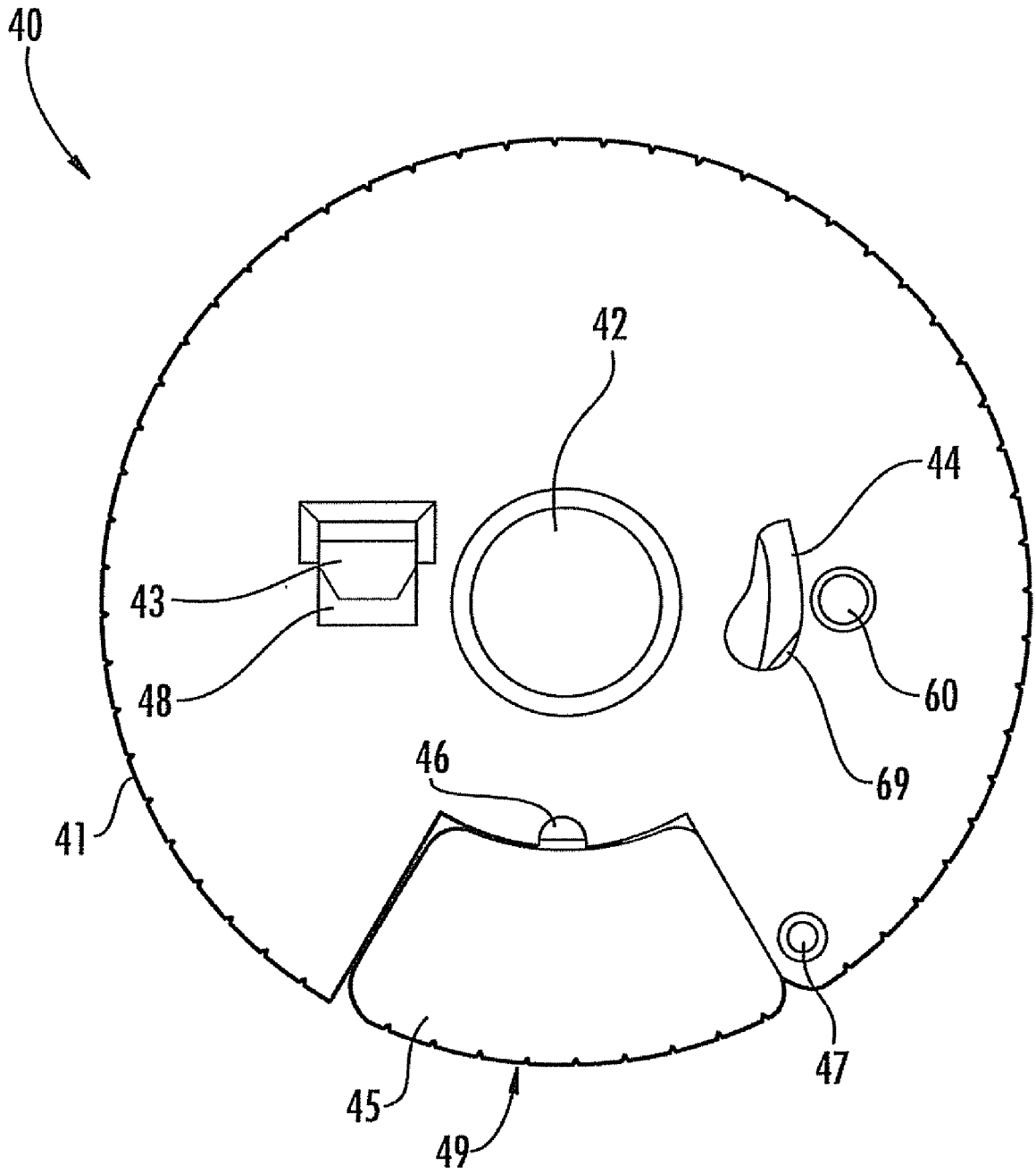
FIG. 14A is front elevational view of a first embodiment of a cable preparation tool for a coaxial cable having a projection being in an outer conductor engaging position, in accordance with the present invention.
Figure 14B:
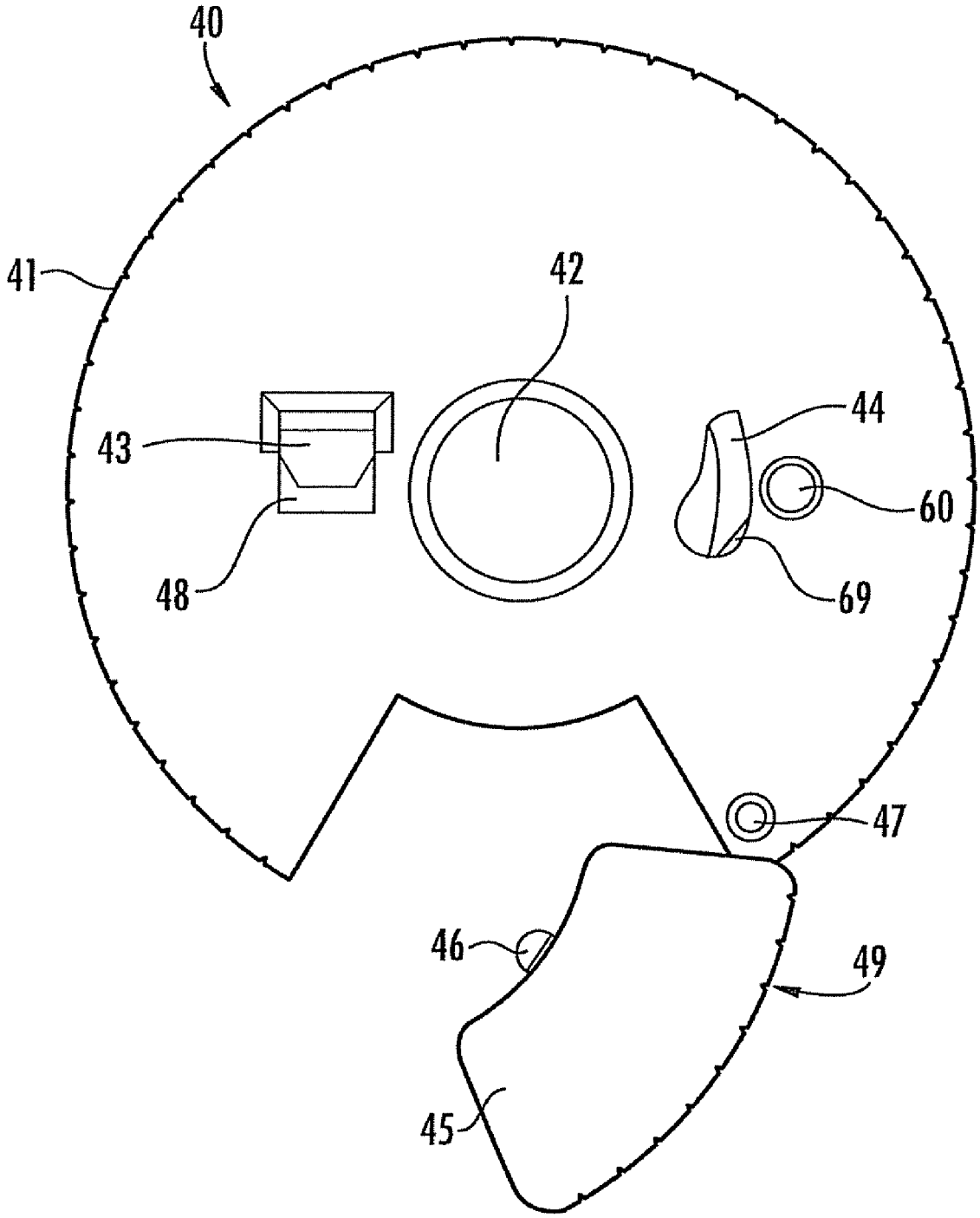
FIG. 14B is a front elevational view of the cable preparation tool of FIG. 14A with the projection in a disengaged position.

The tool 40 also includes a second projection 49 being movable with respect to the body 41 between an outer conductor engaging position (shown in FIG. 14A) and a disengaged position (shown in FIG. 14B). The second projection 49 comprises a base 45 and a forming tip 46 carried thereby. The base 45 is pivotally connected to the body 41 by a hinge pin 47. Of course, it should be appreciated that the base 45 could be connected to the body 41 in other suitable fashions. For example, the base 45 and the second projection 49 can be integrally formed as a monolithic unit and the base may be coupled to the second projection by a tab.

The forming tip 46 corrugates the flared end portion 55 of the outer conductor 31 when the base 46 is in the outer conductor engaging position and the body 41 is rotated relative to the coaxial cable 30. This corrugation results in a corrugated portion 56 of the coaxial cable 30 having a diameter less than that of the outer conductor 31. This advantageously prepares a coaxial cable 30 with a smooth outer conductor 31 to be used with a connector designed for use with a coaxial cable having a corrugated outer conductor. The skilled artisan will understand that corrugating may not be required in certain implementations depending upon the given cable and connector type, and thus in such applications use of the second projection 49 may not be required.

In some applications, at least one of the blade 43, first projection 44, and second projection 49 may be removably mounted to the body 41. This may allow for the replacement of the blade 43, first projection 44, and second projection 49 if one thereof becomes damaged or worn. Further, this may allow for the blade 43 to be removed, sharpened, then reattached to the body 41.

In the illustrated embodiment, the blade 43, first projection 44, and second projection 49 are each on a same side of the body 41. However, it should be recognized that each of the blade 43, first projection 44, and second projection 49 need not each be on a same side of the body 41.

Figure 15B:
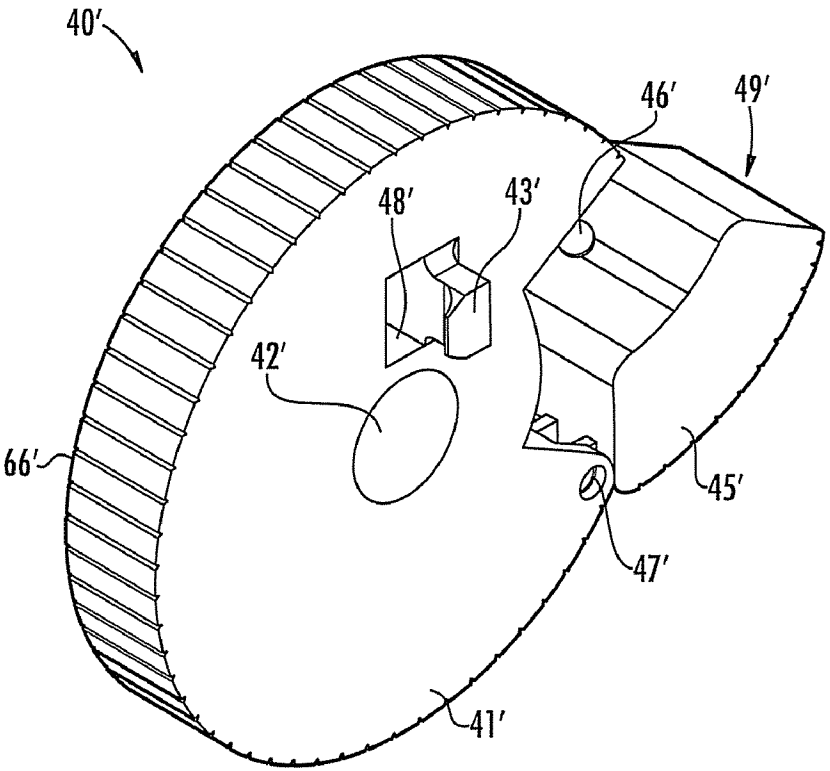
FIG. 15B is a rear perspective view of the cable preparation tool of FIG. 15A.
Figure 15A:
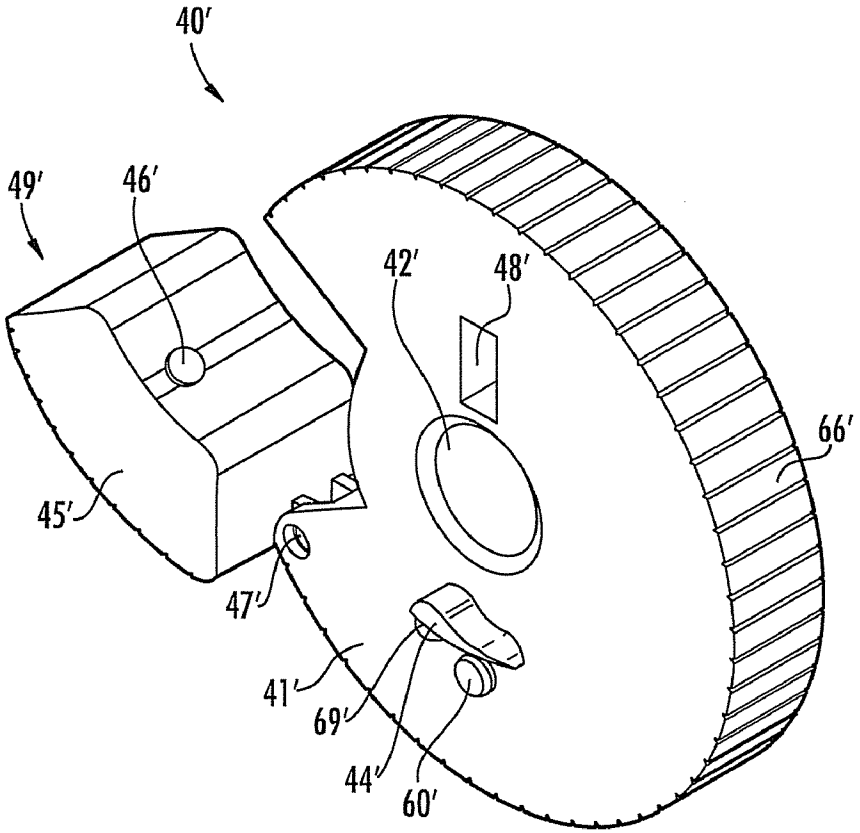
FIG. 15A is a front perspective view of an alternative embodiment of a cable preparation tool for a coaxial cable, in accordance with the present invention.
Figure 16:
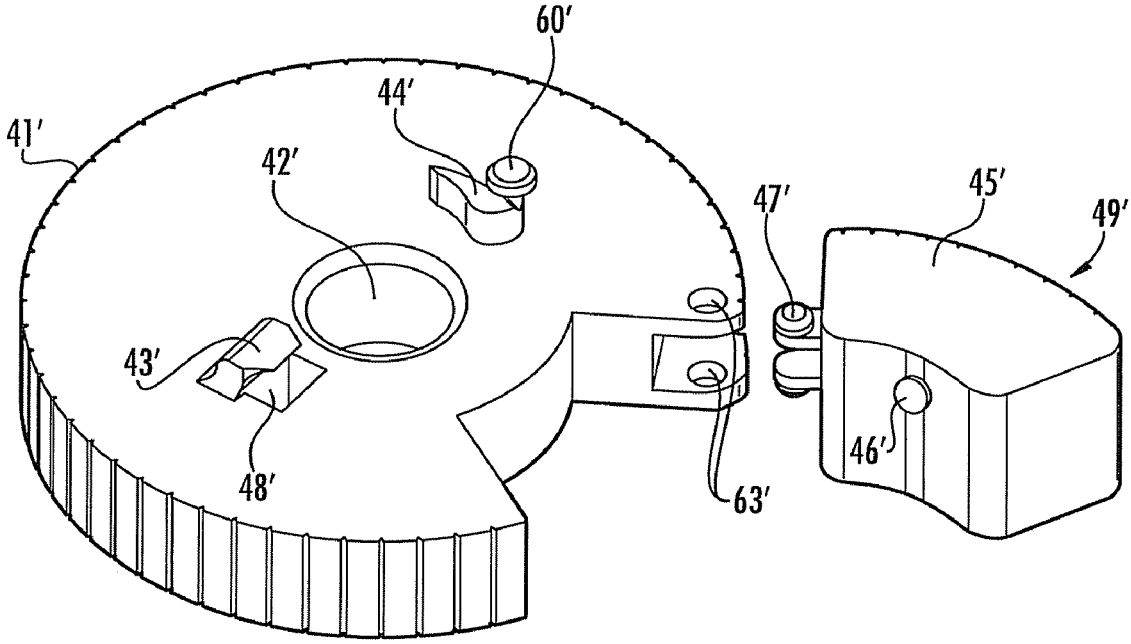
FIG. 16 is a front perspective view of the cable preparation tool of FIGS. 15A-15B wherein the second projection is detached from the body of the cable preparation tool.

Indeed, FIGS. 15A and 15B illustrate an alternative embodiment of the cable end preparation tool 40' where the first projection 44' and second projection 49' are each on carried by a first side 57' of the body 41'. The blade 43' is carried by a second side 58' of the body. This may advantageously allow the dielectric removal and flaring functions of the tool 40' to be performed at separate times. As shown in FIG. 16, rather than a hinge pin, a pair of hinge tabs 47' may extend radially inwardly from the second projection 49'. These hinge tabs 47' are received by hinge tab receiver holes 63' defined in the body 41' of the tool 40'.

Figure 17:
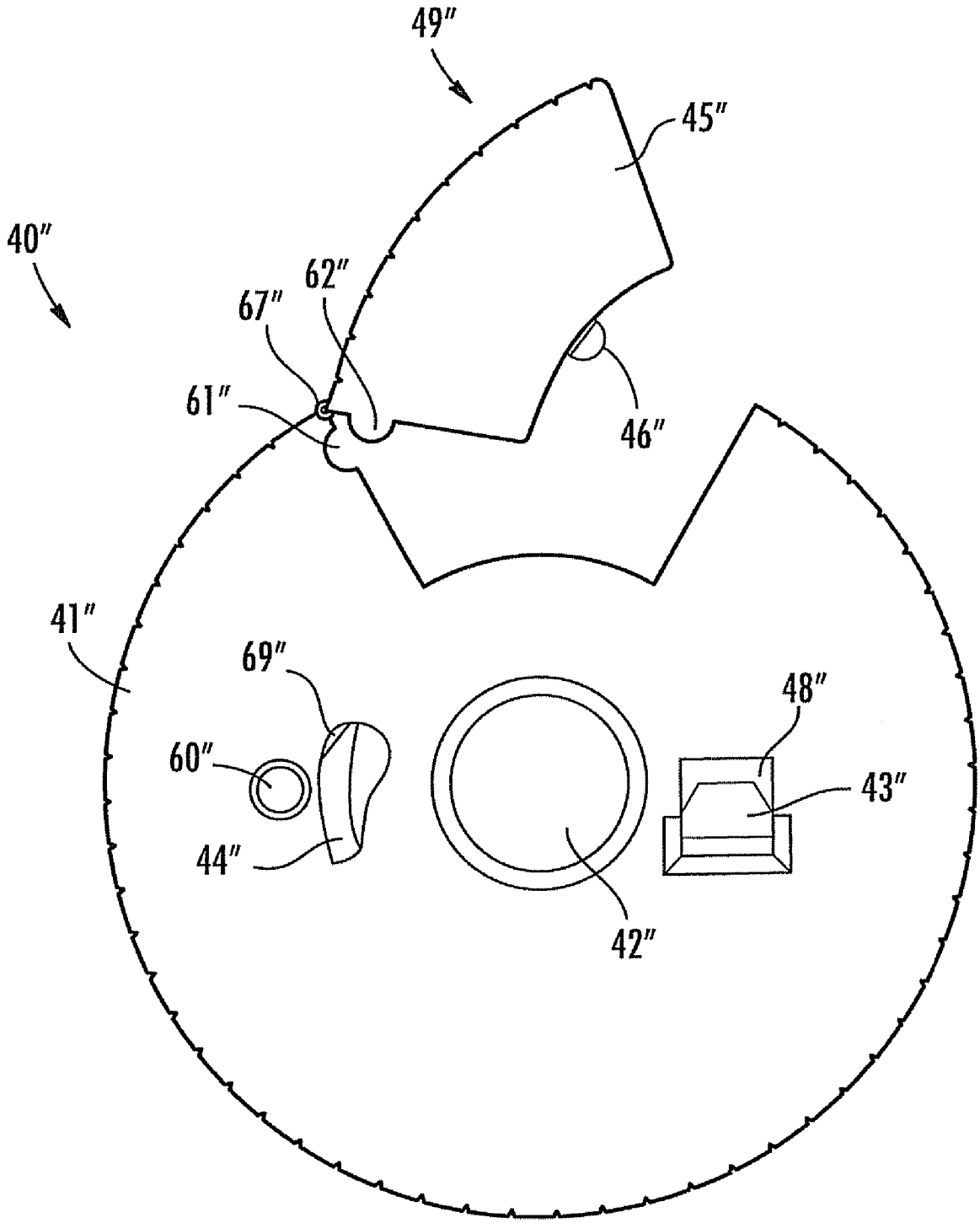
FIG. 17 is a front elevational view of a further embodiment of a cable preparation tool wherein the second projection is attached to the body of the cable preparation tool by a flexible strap, in accordance with the present invention.

With brief reference to FIG. 17, an embodiment of the tool 10" without a hinge pin is described. Rather, the body 41", the blade 43", the first projection 44", and the second projection 49" are integrally formed as a monolithic unit. A flexible strap 67" connects the second projection 49" to the body 41". Furthermore, a stress relieving projection 62" extends outwardly from the second projection 49". This stress relieving projection 62" is received by a groove 61" defined in the body 41" of the tool 40" and reduces stress on the flexible strap 67" when a technician is using the tool 40" to corrugate a coaxial cable.

Figure 18:
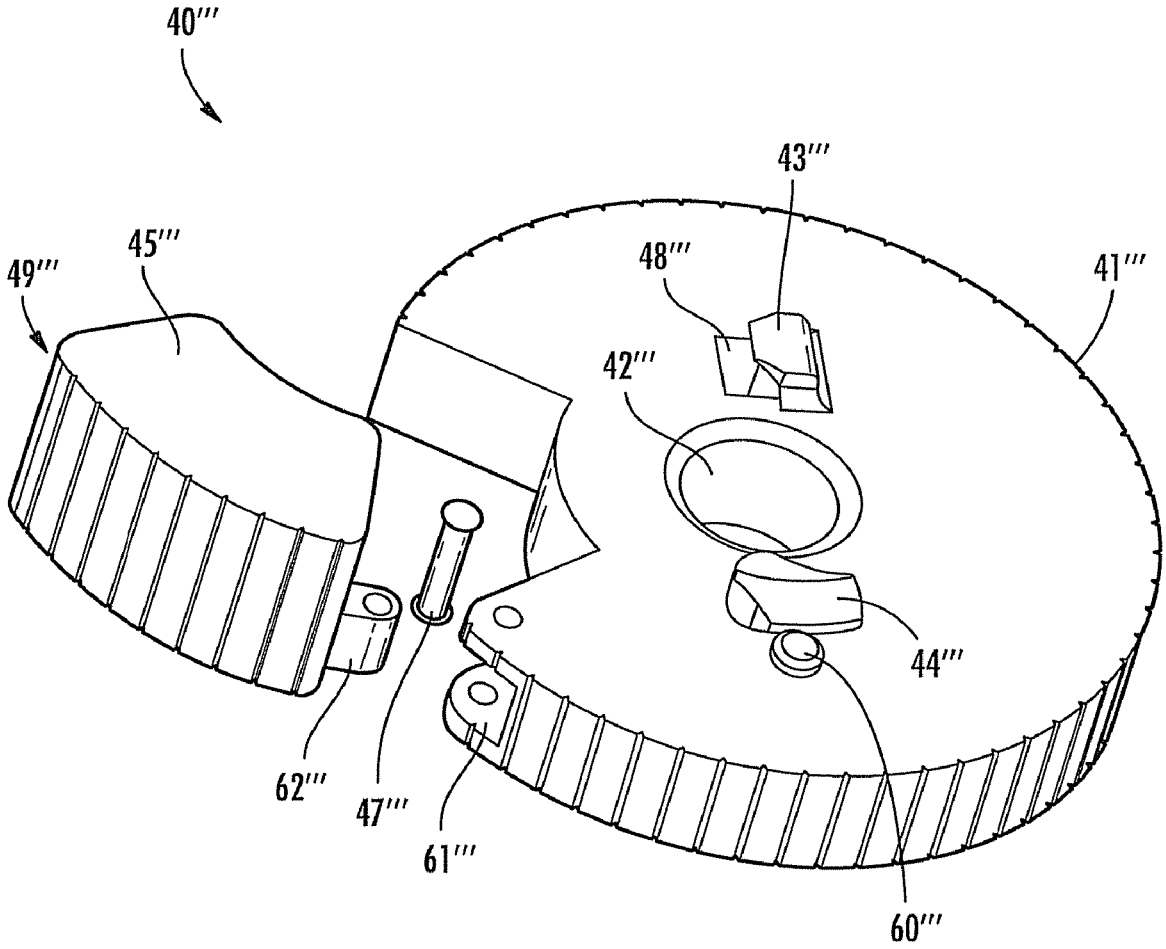
FIG. 18 is a front perspective view of yet another embodiment of a cable preparation tool wherein the second projection is detached from the body of the cable preparation tool, in accordance with the present invention.

Shown in FIG. 18 is an embodiment of the tool 40''' where the body has a retaining groove 61''' defined therein. A retaining projection 62''' extends outwardly from the second projection 49'''. The hinge pin 47''' extends through holes in the retaining groove 61''' and retaining projection 62''' to thereby secure the second projection 49''' to the body 41''' of the tool 40'''.

Figure 19:
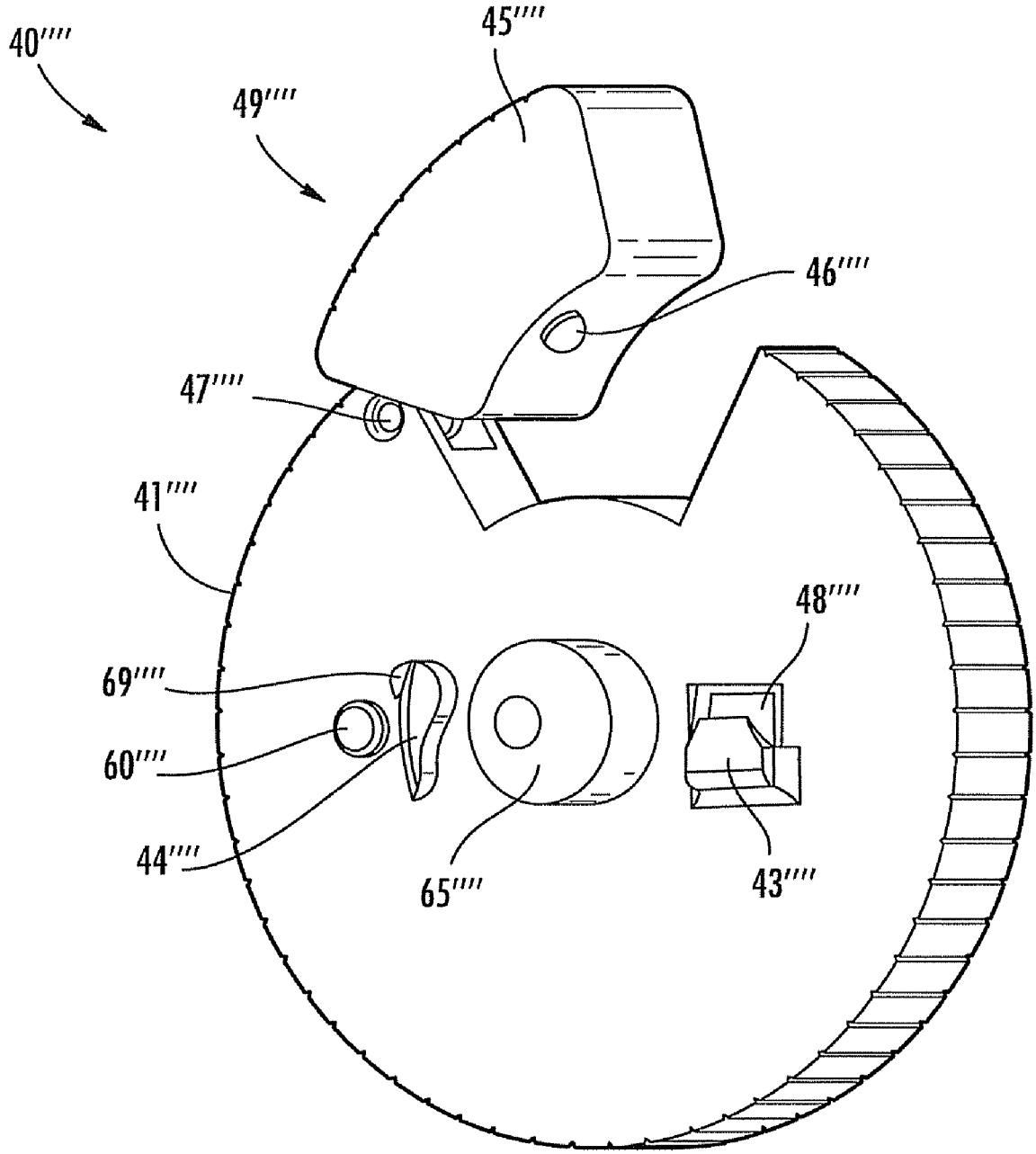
FIG. 19 is a front perspective view of still another embodiment of a cable preparation tool in accordance with the present invention.
Figure 20:
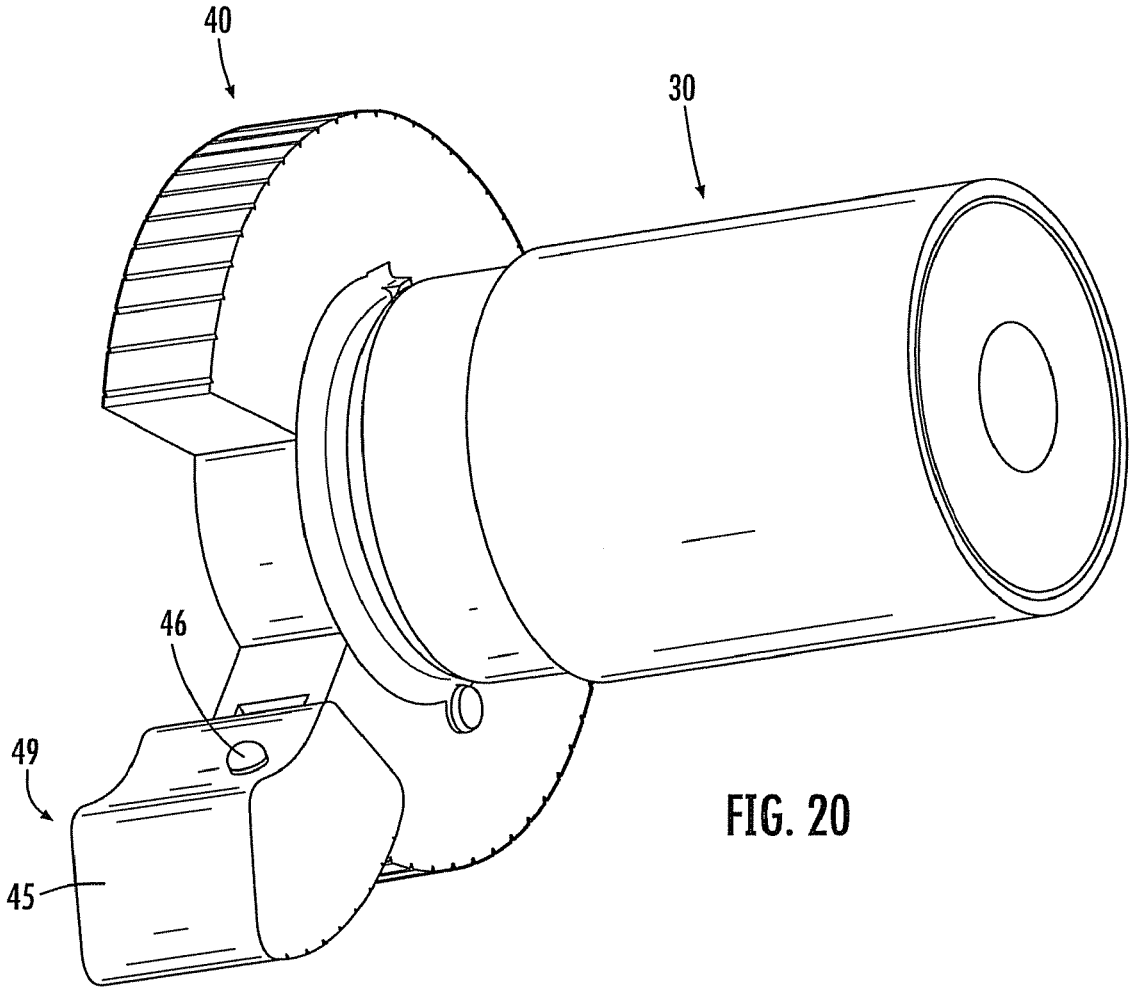
FIG. 20 is a perspective view of the cable preparation tool of FIGS. 14A-14B installed on the end of a coaxial cable.
Figure 21:
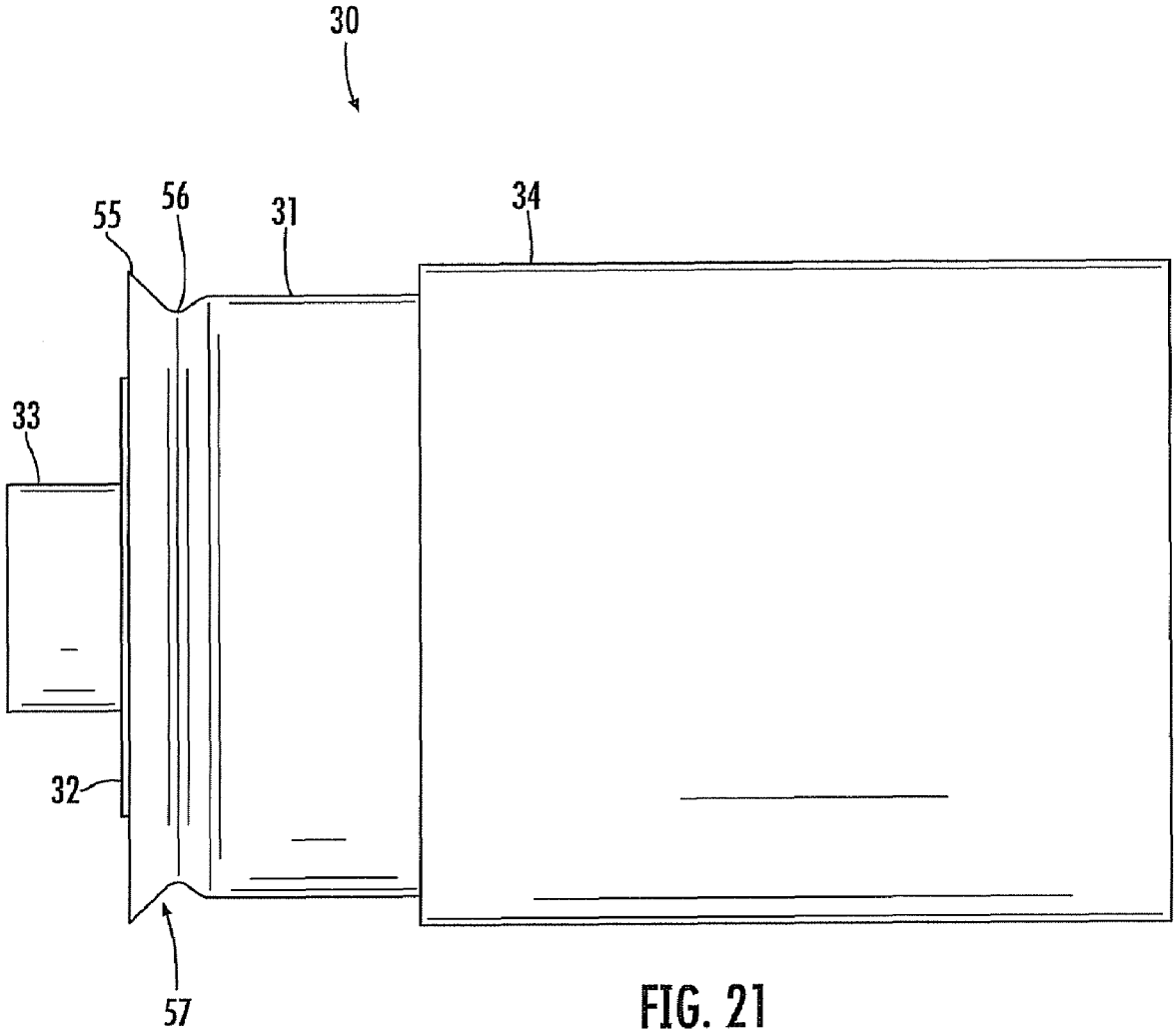
FIG. 21 is a side view of the coaxial cable of FIG. 1 as prepared by the cable preparation tool of the present invention.
Figure 22:
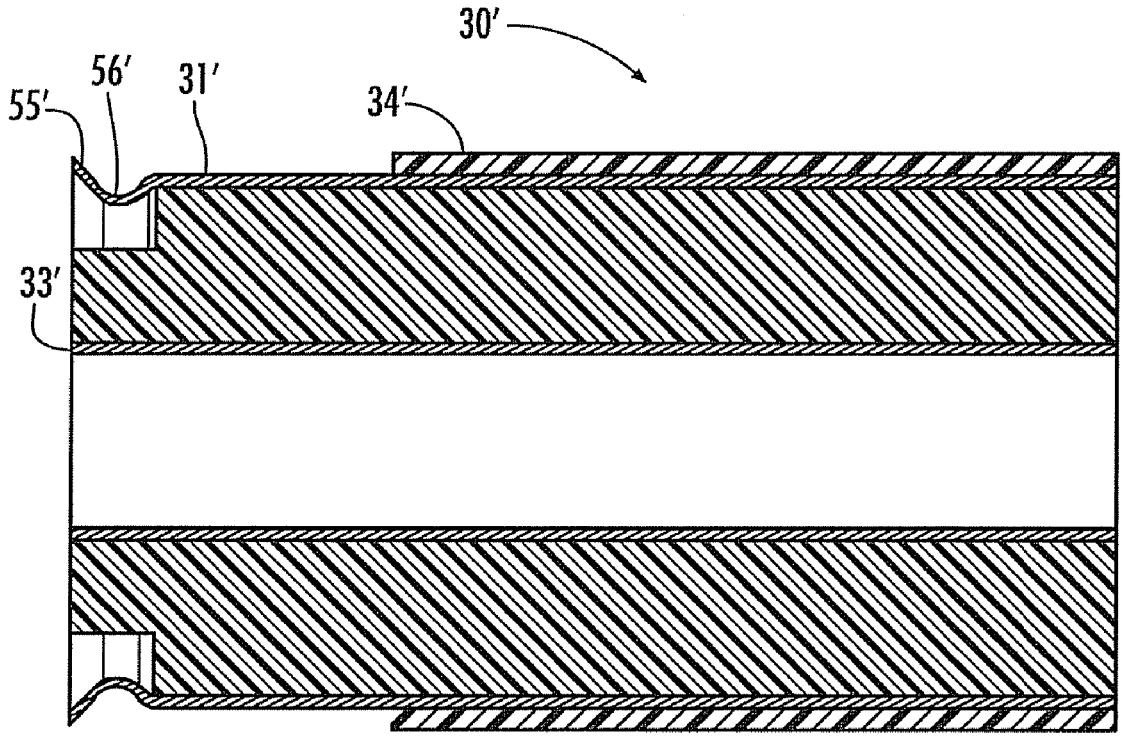
FIG. 22 is a side view of a coaxial cable having a hollow inner conductor as prepared by the cable preparation tool shown in FIG. 19.

Yet another embodiment is shown in FIG. 19. In this embodiment, rather than having a central hole, the body 41'''' carries a central rotation guide 65''''. The central rotation guide 65'''' is to be inserted into a hollow inner conductor 33' (FIG. 22). Once the central rotation guide 65'''' is inserted into the hollow inner conductor 33', the tool 40'''' may be rotated about the coaxial cable 30'. The central rotation guide 65'''' provides support to the inner conductor 33' so that it is not bent or crushes during preparation of the coaxial cable 30'.

With reference to FIGS. 1, 15A, 15B, and 21, a method of preparing a coaxial cable 30 with a cable end preparation tool 40' for use with a connector 10 is now described. First, a technician will typically cut the coaxial cable 30. The coaxial cable 30 may be cut flush, although preferably may be cut so that the outer conductor 31 and dielectric 32 are flush with each other while the inner conductor 33 protrudes therebeyond. The back nut 14 of the connector 10 is then positioned on the coaxial cable 30 and slid away from the cable end.

The inner conductor 33 of the coaxial cable 30 is then inserted into the central opening 42' of the tool 40' so that the second side 58' of the tool is facing the cable end. The body 41' of the tool 40' is then rotated with respect to the cable 30 to thereby remove a portion of the dielectric 32 between the inner conductor 33 and the outer conductor 31.

The tool 40' is then removed from the inner conductor 33 of the cable 30 and replaced on the inner conductor with the first end 57' of the body 41' facing the cable end. The body 41' of the tool 40' is then rotated with respect to the cable 30 to flare an end portion of the outer conductor (see flared end portion 55 of FIG. 6). Furthermore, the second projection 49' of the tool 30' is set to the outer conductor engaging position and the body 41' is rotated with respect to the cable to corrugate the flared end portion 55 of the outer conductor 31 (see corrugation 56 of FIG. 21).

The connector housing 12 is then inserted onto the cable end so that the flared portion 55 of the coaxial cable 30 is positioned adjacent the radially outer ramp 13 and the radially outer support portion 21 of the insulator member 18 is supporting the outer conductor 31. The back nut back nut 14 is then threaded into the connector housing 12 until the positive stop 29 therebetween is engaged. As the back nut 14 is threaded into the connector housing 12, the compressible ring 15 compressibly clamps against the outer conductor 31 opposite the radially outer ramp 13. Of course, those skilled in the art will recognize that the connector 10 and tool 40' as described in this method may have any or all of the features described hereinbefore.

Referring again to FIGS. 14A and 14B, a method aspect is directed to a method of preparing an end of a coaxial cable 30 comprising an inner conductor 31, an outer conductor 33, and a dielectric 32 therebetween, using a cable end preparation tool 40. The method comprises positioning the cable end preparation tool 40 adjacent the coaxial cable 30 end and removing a portion of the dielectric 32 with a blade 43 carried by a body 41 of the cable end preparation tool by rotating the body relative to the coaxial cable. Further, the method includes flaring an end portion of the outer conductor 31 with a first projection 44 carried by the body 41 by rotating the body relative to the coaxial cable 30. In addition, the method includes corrugating the flared end portion of the outer conductor 31 with a second projection 49 carried by the body 41 and being movable with respect to the body between an outer conductor engaging position and a disengaged position by rotating the body relative to the coaxial cable 30 when the second projection is in the outer conductor engaging position.

Other details of such connectors 10 for coaxial cables 30 may be found in co-pending applications CONNECTOR WITH POSITIVE STOP FOR COAXIAL CABLE AND ASSOCIATED METHODS, Ser. No. 12/244,162, FLARING COAXIAL CABLE END PREPARATION TOOL AND ASSOCIATED METHODS, Ser. No. 12/277,152, CONNECTOR WITH POSITIVE STOP AND COMPRESSIBLE RING FOR COAXIAL CABLE AND ASSOCIATED METHODS, Ser. No. 12/277,103, and CONNECTOR WITH RETAINING RING FOR COAXIAL CABLE AND ASSOCIATED METHODS, Ser. No. 12/277,172, the entire disclosures of which are hereby incorporated by reference.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A connector to be attached to a coaxial cable comprising an inner conductor, an outer conductor having a corrugated end, and a dielectric therebetween, the connector comprising:

a connector housing defining a radially outer ramp to receive the corrugated end of the outer conductor thereagainst;

a back nut;

a compressible ring to compressibly clamp the outer conductor against the radially outer ramp as the connector housing and back nut are engaged;

a center contact to be coupled to the inner conductor; and an insulator member in said connector housing for carrying said center contact and comprising a radially outer support portion to radially support the outer conductor opposite said compressible ring.

2. The connector of claim 1 wherein said compressible ring comprises an electrically conductive compressible ring.

3. The connector of claim 1 wherein said compressible ring comprises an electrically conductive compressible ring having a polymer coating.

4. The connector of claim 1 wherein said clamping ring comprises a compressible coil spring having an axis coaxial with said connector housing.

5. The connector of claim 1 wherein said connector housing and said back nut include respective portions defining a positive stop when fully engaged.

6. The connector of claim 5 wherein said connector housing comprises a rearward end; wherein said back nut comprises a shoulder; and wherein said positive stop is defined by the rearward end and the shoulder.

7. The connector of claim 1 wherein said back nut includes a forward portion threadingly received with a rearward portion of said connector housing.

8. The connector of claim 1 further comprising at least one sealing ring carried within said back nut.

9. The connector of claim 8 wherein said back nut has a sealing ring cavity defined therein; wherein said at least one sealing ring comprises a sealing ring body and a retaining projection extending outwardly therefrom; and wherein said retaining projection of said sealing ring is received by the sealing ring cavity.

10. The connector of claim 1 wherein the back nut comprises a polymer composite back nut.

11. The connector of claim 1 wherein the outer conductor of the coaxial cable comprises a corrugated outer conductor.

12. The connector of claim 1 wherein the outer conductor of the coaxial cable comprises a smooth outer conductor.

13. A connector to be attached to a coaxial cable comprising an inner conductor, an outer conductor, and a dielectric therebetween, the connector comprising:

a connector housing defining a radially outer ramp to receive the outer conductor thereagainst;

a back nut;

a compressible coil spring having an axis coaxial with said connector housing to compressibly clamp the outer conductor against the radially outer ramp as the connector housing and back nut are engaged;

a center contact to be coupled to the inner conductor; and an insulator member in said connector housing for carrying said center contact and comprising a radially outer support portion to radially support the outer conductor opposite said compressible coil spring.

14. The connector of claim 13 wherein said connector housing and said back nut include respective portions defining a positive stop when fully engaged.

15. The connector of claim 14 wherein said connector housing comprises a rearward end; wherein said back nut comprises a shoulder; and wherein said positive stop is defined by the rearward end and the shoulder.

16. The connector of claim 13 further comprising at least one sealing ring carried within said back nut.

17. The connector of claim 13 wherein the outer conductor of the coaxial cable comprises a corrugated outer conductor.

18. The connector of claim 13 wherein the outer conductor of the coaxial cable comprises a smooth outer conductor.

19. A method of making a connector to be attached to a coaxial cable comprising an inner conductor, an outer conductor having a corrugated end, and a dielectric therebetween, the method comprising:

defining a radially outer ramp on a connector housing to receive the corrugated end of the outer conductor thereagainst;

forming a compressible ring to compressibly clamp the outer conductor against the radially outer ramp as the connector housing and a back nut are engaged; and forming an insulator member to be positioned in the connector housing for carrying a center contact to be coupled to the inner conductor and comprising a radially outer support portion to radially support the outer conductor opposite the compressible ring.

20. The method of claim 19 wherein the compressible ring comprises an electrically conductive compressible ring.

21. The method of claim 19 wherein the clamping ring comprises a compressible coil spring having an axis coaxial with the connector housing.

22. The method of claim 19 wherein the connector housing and the back nut include respective portions defining a positive stop when fully engaged.

23. The method of claim 22 wherein the connector housing comprises a rearward end; wherein the back nut comprises a shoulder; and wherein the positive stop is defined by the rearward end and the shoulder.

* * * * *

UNITED STATES PATENT AND TRADEMARK OFFICE

CERTIFICATE OF CORRECTION

PATENT NO. : 7,731,529 B1
APPLICATION NO. : 12/277125
DATED : June 8, 2010
INVENTOR(S) : Islam It is certified that error appears in the above-identified patent and that said Letters Patent is hereby corrected as shown below:

| | |
|---|---|
| Title Page, item (65), Prior Publication Data | Insert: --**Prior Publication Data**<br>US 2010/0130060 Al May 27, 2010-- |
| Column 7, Line 7 | Delete: "12″"<br>Insert: --12″′-- |
| Column 9, Line 18 | Delete: "on" |
| Column 9, Line 54 | Delete: "crushes"<br>Insert: --crushed-- |
| Column 10, Line 17 | Delete: "back nut back nut"<br>Insert: --back nut-- |

Signed and Sealed this

Twenty-eighth Day of September, 2010

David J. Kappos

David J. Kappos
*Director of the United States Patent and Trademark Office*